US010175622B2

(12) United States Patent
Yamamoto et al.

(10) Patent No.: US 10,175,622 B2
(45) Date of Patent: Jan. 8, 2019

(54) FUSER WITH PRESSURE PAD AND IMAGE FORMING DEVICE HAVING THE SAME

(71) Applicant: Konica Minolta, Inc., Chiyoda-ku, Tokyo (JP)

(72) Inventors: Koji Yamamoto, Toyokawa (JP); Shoichi Yoshikawa, Okazaki (JP); Masahiro Yamaguchi, Toyokawa (JP); Seiji Shibata, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/837,374

(22) Filed: Dec. 11, 2017

(65) Prior Publication Data

US 2018/0164723 A1 Jun. 14, 2018

(30) Foreign Application Priority Data

Dec. 9, 2016 (JP) ..... 2016-239549

(51) Int. Cl.
*G03G 15/20* (2006.01)

(52) U.S. Cl.
CPC ..... *G03G 15/2053* (2013.01); *G03G 15/2042* (2013.01); *G03G 2215/2035* (2013.01); *G03G 2215/2061* (2013.01); *G03G 2215/2064* (2013.01)

(58) Field of Classification Search
USPC ..... 399/107, 110, 122, 320, 328, 329
See application file for complete search history.

(56) References Cited

U.S. PATENT DOCUMENTS

| | | | | |
|---|---|---|---|---|
| 7,333,762 | B2 * | 2/2008 | Oishi | G03G 15/206 399/329 |
| 9,091,980 | B2 * | 7/2015 | Egi | G03G 15/2053 |
| 9,746,804 | B1 * | 8/2017 | Ichiki | G03G 15/206 |

FOREIGN PATENT DOCUMENTS

| | | | |
|---|---|---|---|
| JP | 2009-109931 | A | 5/2009 |
| JP | 2009-222810 | A | 10/2009 |
| JP | 2009-300472 | A | 12/2009 |
| JP | 2013-160910 | A | 8/2013 |
| JP | 2013-195991 | A | 9/2013 |
| JP | 2014-178555 | A | 9/2014 |
| JP | 2014-199309 | A | 10/2014 |

* cited by examiner

*Primary Examiner* — Hoan Tran
(74) *Attorney, Agent, or Firm* — Buchanan Ingersoll & Rooney PC

(57) ABSTRACT

A fuser includes a pressure pad forming a nip with a fuser belt between the pad and a fuser rotator. A pressure face in contact with the belt has profiles in planes normal to the axis of the rotator. The profiles each include a reference section, the first to come into contact with the rotator with the belt in between when the pad forms the nip, and a boundary section at a threshold distance from the reference section in the width direction of the nip. When the pad is apart from the nip due to removal of a force applied by a pusher unit, the boundary section is, relative to the reference section, more largely displaced in the opposite direction to that of the rotator in one of the profiles located at a larger distance from a center portion of the pad in the axial direction of the rotator.

16 Claims, 10 Drawing Sheets

FUSER WITH PRESSURE PAD AND IMAGE FORMING DEVICE HAVING THE SAME

Japanese Patent Application No. 2016-239549 filed on Dec. 9, 2016, is incorporated herein by reference in its entirety.

BACKGROUND OF THE INVENTION

1. Field of the invention

The invention relates to electrophotographic image forming devices, and in particular, structure of fusers mounted in the devices.

2. Background

Electrophotographic image forming devices such as laser printers, faxes, and copiers are equipped with fusers, which are devices for fixing a toner image on a sheet such as a piece of printing paper and a page of a document. In particular, a fuser for thermal fixing includes a fusing member and a pressing member, which are each a rotator such as a roller or a belt. A fuser equipped with rollers as both the members is referred to as a "roller-type" fuser; see, e.g. JP 2009-300472. A fuser equipped with a belt as either of the members is referred to as a "belt-type" fuser; see, e.g. JP 2009-109931, JP 2014-199309, JP 2013-160910, JP 2013-195991, or JP 2014-178555. In thermal fixing, the fusing member is heated, and at the same time, its outer peripheral surface is pressed by the outer peripheral surface of the pressing member to form a nip. Under these conditions, both the members rotate in opposite directions. Passing through this nip, a sheet is subjected to heat and pressure. Granulated toner attached on the surface of the sheet melts and permeates the surface during the passage of the sheet through the nip, and upon movement of the sheet out of the nip, the toner is cooled and solidified again. Thus, the toner image is fixed on the surface of the sheet.

Uneven toner fixing and paper wrinkling are known as typical problems for the fusers. When the fusing member is pressed by the pressing member, both the members are generally deflected in a direction normal to their axes. With these deflections, the pressure applied to a sheet during its passage through the nip between the members, which is hereinafter referred to as "nip pressure," varies in the axial direction. When the amount of this variation is too large, toner fails to be fixed and falls off the area where the nip pressure is insufficient. This can result in deterioration in toner image quality due to rubbing off or the like. On the other hand, in the area where the nip pressure is excessive, a sheet is more likely to wrap around either of the fusing and pressing members than other areas. At the boundary between the areas, the sheet can thus deform and further wrinkle.

As ideas for preventing uneven toner fixing and paper wrinkling, the below-listed technologies are known, for example. For a roller-type fuser, a technology adjusts the force that the pressure roller applies to the fuser roller according to changes in sheet velocity caused by axial variation in nip pressure; see, e.g. JP 2009-300472. Thus, homogenized velocities of sheets can prevent uneven toner fixing and paper wrinkling In a belt-type fuser, a roller or a pressure pad or its holding member included in either of the fixing and pressing members is deflected in a direction normal to its axis when the fixing member is pressed by the pressing member. The deflection is compensated for or absorbed by difference in hardness of pressure pads, see, e.g. JP 2009-109931; difference in elasticity of holding members, see, e.g. JP 2014-199309; or undulation of the surface of a pressure pad, see, e.g. JP 2013-160910, JP 2013-195991, or JP 2014-178555. Thus, the nip pressure homogenized in the axial direction can prevent uneven toner fixing and paper wrinkling.

SUMMARY OF THE INVENTION

Recently, printers and multi-function peripherals (MFP) have become popular for not only small-scale offices such as small offices/home offices (SOHOs) but also standard homes. Accordingly, further size reduction and electricity saving are required of printers and MFPs, including electrophotographic types of them. In order to meet the demand, belt-type fusers are expected to have an advantage over roller-type ones. Indeed, belts are thinner than rollers, and thus their sizes are easier to reduce. In addition, belts have smaller heat capacity than rollers, and thus their power consumptions are easier to lower.

In contrast to roller-type fusers, belt-type ones have a difficulty in properly accommodating paper of types frequently used at SOHOs and homes, such as thin paper and envelopes. This is caused by the following reason. Paper of such types is easier to deform than plain paper, and thus, when pressed by a fuser in the same manner as plain paper, is more likely to wrinkle. Accordingly, fusers require ingenuity to apply lighter loads to paper of such types than to plain paper. Changes in loads applied to sheets cause changes in the amount of deflection of fixing and pressing members. In general, pressure pads and their holding members are easier to deflect in directions normal to their axial directions than rollers. In particular, the difference in the amounts of deflection is larger for fusers of smaller size. Hence, changes in loads applied to sheets cause a larger variation of nip pressure distribution in the axial directions in belt-type fusers than in roller-type ones. The well-known technology of compensating for or absorbing the variation of nip pressure distribution with the structure of a pressure pad is based on a constant load applied to sheets, and thus, it is difficult to reduce the risk of uneven toner fixing and paper wrinkling caused by the variation of nip pressure if the loads are changed.

An object of the invention is to solve the above-mentioned problems, and in particular, to provide a belt-type fuser capable of properly maintaining nip pressure distribution in the axial direction regardless of changes in loads applied to sheets.

A fuser according to one aspect of the invention is a fuser for applying heat and force to the surface of a sheet with a toner image transferred thereon to fix the toner image on the surface of the sheet. The fuser includes an endless fuser belt, a fuser rotator extending along a rotation axis, a pressure pad, a holding member, a heater unit, and a pusher unit. The pressure pad forms a nip, along with the fuser rotator, with the fuser belt between the pressure pad and the outer peripheral surface of the fuser rotator. The holding member is elongated in the axial direction of the fuser rotator and holds the pressure pad. The heater unit applies heat to one of the fuser belt and the outer peripheral surface of the fuser rotator. The pusher unit applies a force of variable strength between the outer peripheral surface of the fuser rotator and the pressure pad. The pressure pad includes a pressure face to be in contact with the fuser belt at the nip. The pressure face has profiles at edges of cross sections of the pressure pad when the pressure pad is apart from the nip due to removal of an external force pressing one of the fuser rotator and the pressure pad onto the other; the cross sections of the pressure pad are intersections with virtual planes normal to a rotation axis of the fuser rotator. The profiles each include a reference section and a boundary section. The reference section is to be the first to come into contact with the outer peripheral surface of the fuser rotator with the fuser belt in between when the pressure pad forms the nip due to reception of the force from the pusher unit. The boundary section is located at a threshold distance from the reference section in the width direction of the nip. The pressure face is shaped such that the boundary section is, relative to the reference section, more largely displaced in the opposite direction to the direction of the fuser rotator in one of the profiles located at a larger distance from a center portion of the pressure pad in the axial direction of the fuser rotator.

An image forming apparatus according to one aspect of the invention includes an imaging device forming a toner image on an image carrier, a transfer device transferring the toner image onto a sheet, and the above-described fuser.

BRIEF DESCRIPTION OF THE DRAWINGS

These and other objects, advantages, and features of the invention will become apparent from the following description thereof taken in conjunction with the accompanying drawings which illustrate a specific embodiment of the invention. In the drawings.

DETAILED DESCRIPTION

The following is a description of an embodiment of the invention with reference to the drawings. However, the scope of the invention is not limited to the disclosed embodiment.

Appearance of Image Forming System

Figure 1A:
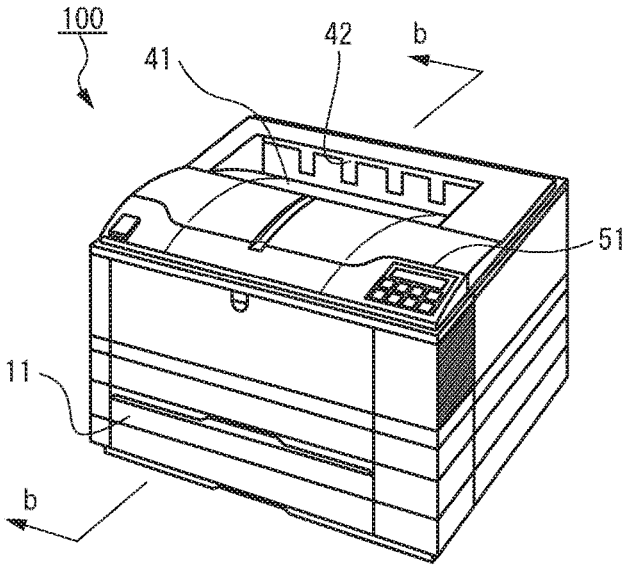
FIG. 1A is a perspective view of the appearance of an image forming apparatus according to an embodiment of the invention.

FIG. 1A is a perspective view of the appearance of an image forming apparatus according to an embodiment of the invention. The image forming apparatus 100 is a printer, which has, on the top of its body, an ejection tray 41 that stores sheets ejected from an ejection slot 42 located at the back of the tray. The printer 100 also has, in front of the ejection tray 41, an operation panel 51 embedded, and in the bottom of its body, paper cassettes 11 attached to be able to slide out like drawers.

Internal Configuration of Printer

Figure 1B:
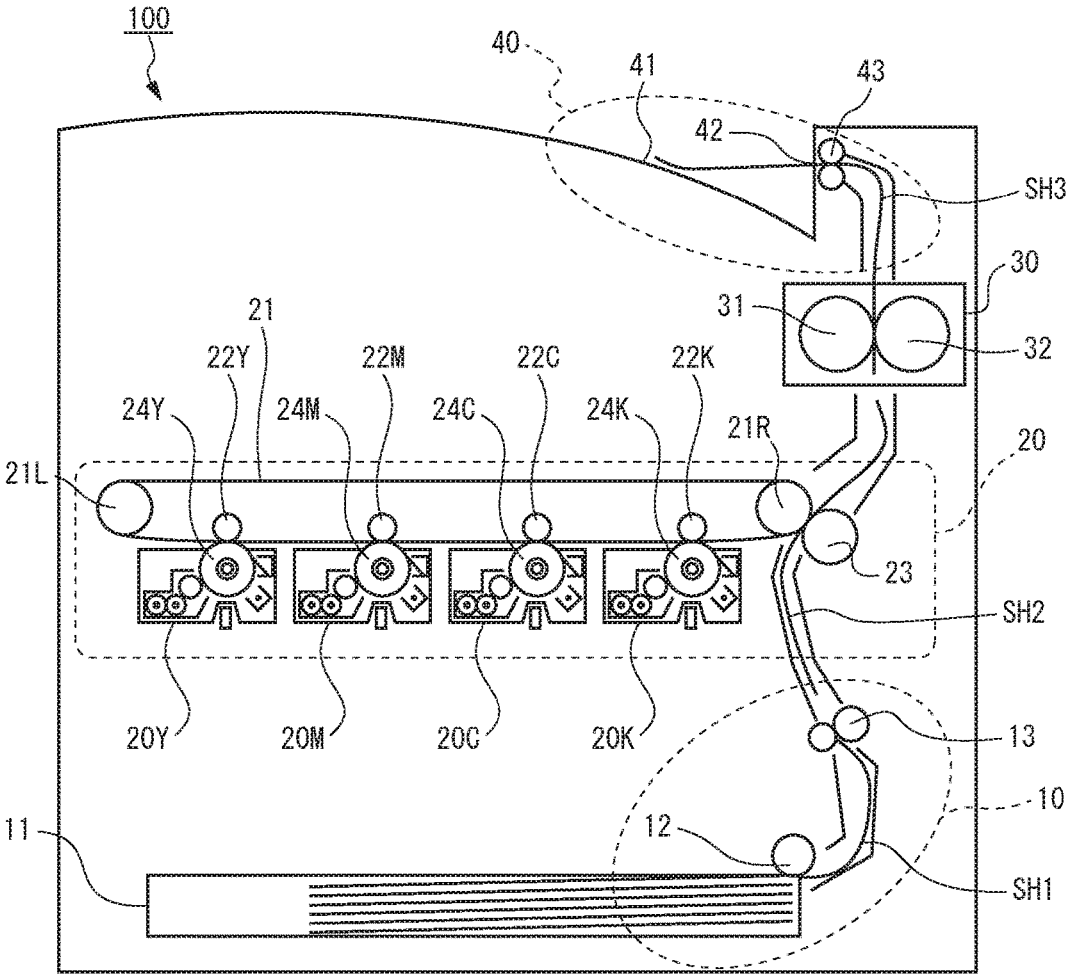
FIG. 1B is a schematic cross-sectional view of the image forming apparatus along the line b-b shown in FIG. 1A.

FIG. 1B is a schematic cross-sectional view of the printer 100 along the line b-b shown in FIG. 1A. The printer 100, which is an electrophotographic type capable of color printing, includes a feeder device 10, an imaging device 20, a fuser device 30, and an ejecting device 40.

The feeder device 10 first, with a pickup roller 12, separates each sheet SH1 from a stack of sheets SHT stored in a paper cassette 11, and next, with a timing roller 13, feeds each separated sheet to the imaging device 20 in synchronization with its action. The term "sheets" means film-, or thin-plane-shaped materials, products, or print pieces made of paper or resin. Paper types, i.e. types of sheets storable in the paper cassette 11 include plain, high-quality, color-copier, coated, etc.; and sizes of the sheets include A3, A4, A5, B4, etc. The sheets can be stored in the longitudinal or transverse position.

The imaging device 20 is, for example, a printing engine of intermediate transfer type, which includes four tandem photoreceptor units 20Y, 20M, 20C, 20K, an intermediate transfer belt 21, four primary transfer rollers 22Y, 22M, 22C, 22K, and a secondary transfer roller 23. The intermediate transfer belt 21 rotatably wraps around a driven pulley 21L and a driving pulley 21R. In a space between these pulleys 21L, 21R, the four photoreceptor units 20Y-20K and the four primary transfer rollers 22Y-22K are arranged such that each of the photoreceptor units is paired with one of the primary transfer rollers with the intermediate transfer belt 21 in between. The secondary transfer roller 23, along with the driving pulley 21R, forms a nip with the intermediate transfer belt 21 in between. In the photoreceptor units 20Y-20K, their respective photoreceptor drums 24Y, 24M, 24C, 24K, along with the primary transfer rollers 22Y-22K facing the drums across the intermediate transfer belt 21, form nips with the belt in between. During rotation of intermediate transfer belt 21, counterclockwise rotation in FIG. 1B, the photoreceptor units 20Y-20K, when accepting the same surface portion of the intermediate transfer belt 21 passing through the nips between their respective photoreceptor drums 24Y-24K and the primary transfer rollers 22Y-22K, form on the same surface portion of the belt monochromatic toner images of their respective colors, i.e., yellow (Y), magenta (M), cyan (C), and black (K). These four monochromatic toner images then overlap onto the same surface position of the belt and form a single polychromatic toner image. At the same time when this polychromatic toner image passes through the nip between the driving roller 23R and the secondary transfer roller 23, a sheet SH2 is sent from the timing roller 13 to the nip. At the nip, the polychromatic toner image is thus transferred from the intermediate transfer belt 21 onto the sheet SH2.

The fuser device 30 thermally fixes a toner image to the sheet SH3 conveyed from the imaging device 20. More specifically, the fuser device 30 makes a fuser belt 31 and a pressure roller 32 rotate, and sends the sheet SH3 to the nip therebetween. Then, the fuser belt 31 applies heat to the surface of the sheet SH3, and the pressure roller 32 applies pressure to the same surface of the sheet SH3 to press the surface against the fuser belt 31. Due to the heat from the fuser belt 31 and the pressure from the pressure roller 32, the toner image is fixed onto the surface of the sheet SH3. The fuser device 30 further conveys the sheet SH3 to the ejecting device 40 by the rotation of the fuser belt 31 and pressure roller 32.

The ejecting device 40 ejects the sheet SH3 with a toner image fixed thereon from the ejection slot 42 to the ejection tray 46. More specifically, the ejecting device 40 uses ejecting rollers 43, which are disposed inside of the ejection slot 42, to eject the sheet SH3 coming from the top portion of the fuser device 30 to the ejection slot 42 and store it on the ejection tray 41.

Configuration of Fuser

Figures 2A, 2B:
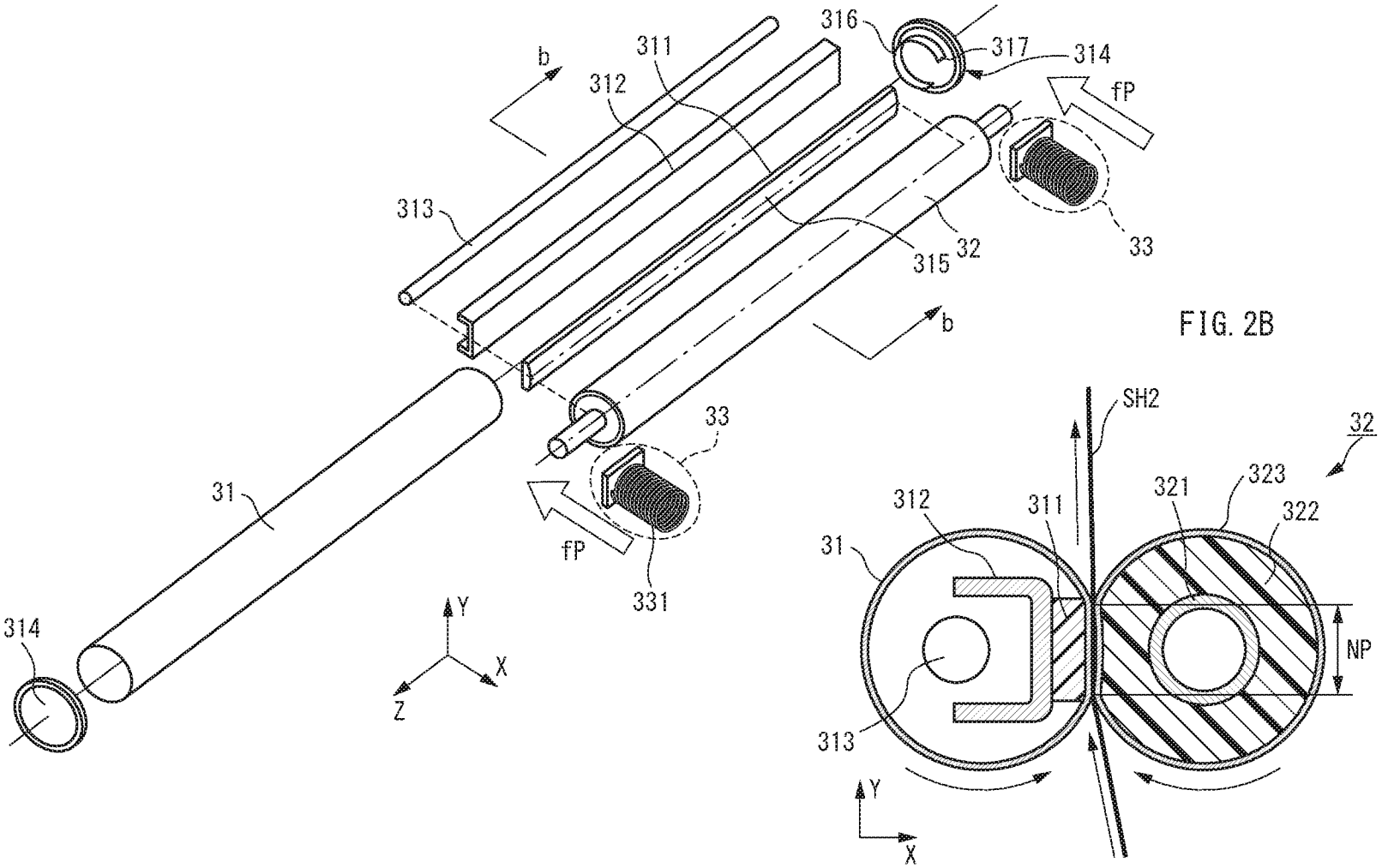
FIG. 2A is an exploded perspective view of the fuser belt and pressure roller of the fuser shown in FIG. 1B.
FIG. 2B is a cross-sectional view along the line b-b shown in FIG. 2A.

FIG. 2A is an exploded perspective view of the fuser belt 31 and pressure roller 32 of the fuser 30 shown in FIG. 1B. FIG. 2B is a cross-sectional view along the line b-b shown in FIG. 2A. The fuser 30 includes, as well as the fuser belt 31 and pressure roller 32, a pressure pad 311, a holding member 312, a heater unit 313, caps 314, and a pusher unit 33.

The fuser belt 31 and pressure roller 32 are arranged with their rotation axes parallel to each other and with their outer peripheral surfaces in contact with each other. This contact area, i.e. the nip NP is extended to, for example, several millimeters in width in the direction normal to a virtual plane including both the rotation axes of the fuser belt 31 and pressure roller 32 (the Y-axis direction, in FIGS. 2A and 2B). Into this nip NP, a sheet SH2 sent from the imaging device 20 is inserted.

The fuser belt 31 is, for example, an endless belt in the form of a long thin circular cylinder some dozens of centimeters long, some millimeters to some dozens of millimeters in diameter, and some hundreds of micrometers to some millimeters in thickness. The fuser belt 31 includes, for example, a base layer, an elastic layer, and a release layer, in increasing order of radius. The base layer is made of a high-strength heat-resist resin film such as polyimide (PI) or a metal foil such as stainless steel (SUS) or nickel, and keeps the fuser belt 31 in cylindrical shape. The elastic layer is made of a fluorine resin film such as polytetrafluoroethylene (PFA), and prevents an offset of toner melt within the nip NP at high temperature and pressure, i.e. transfer of the toner from the surface of the sheet SH2 to the outer peripheral surface of the fuser belt 31. In addition, the fuser belt 31 is a free belt, i.e. it wraps around no rotators such as pulleys.

The pressure pad 311, holding member 312, and heater unit 313 are located in a hollow surrounded by the fuser belt 31. The pressure pad 311 is a long thin plate member extending in the axial direction of the fuser belt 31 (the Z-axis direction, in FIGS. 2A and 2B), for example, made of heat-resistant resin such as liquid crystal polymer (LCP) or polyphenylenesulfide (PPS). The pressure pad 311 forms the nip NP with the fuser belt 31 between the pad and the outer peripheral surface of the pressure roller 32. In this nip NP, a plate surface 315 on one side of the pressure pad 311 is in contact with the fuser belt 31. This plate surface 315 is hereinafter referred to as "pressure face." The holding member 312 is a long plate member extending in the axial direction of the fuser belt 31 (the Z-axis direction), for example, a channel metal plate, i.e. a metal plate U-shaped in cross section, made of metal such as electrolytic zinc-coated steel (SECC), SUS, or aluminum. The holding member 312 has a plate face attached to a plate face of the pressure pad 311 on its opposite side from the pressure face. The holding member 312 also has longitudinal ends fixed to a frame surrounding the fuser 30, not shown in FIGS. 2A and 2B. The holding member 312 thus holds the pressure pad 31 at the same position relative to the frame. The heater unit 313 is, for example, a long thin rod-shaped halogen heater extending in the axial direction of the fuser belt 31 (the Z-axis direction), and by heat emission caused by light emission, applies heat to the inside of the fuser belt 31 and maintains its temperature within a range from a hundred and some tens of degrees Celsius to some hundreds of degrees Celsius, for example. The caps 314 are each a circular disc member with an outer diameter larger than that of the fuser belt 31, and made of heat-resistant resin, such as PI. The caps 314 include, on their respective inner plate surfaces, circular-ring-shaped protrusions 316, which each have a cross section normal to its projecting direction with an outer diameter substantially equal to the inner diameter of the fuser belt 31. The protrusions 316 each have a cutout 317. The caps 314 fill up the openings of either ends of the fuser belt 31; inside the openings, the protrusions 316 are placed such that the pressure pad 311 is positioned in their cutouts 317. As a result, the fuser belt 31 is supported by the pressure pad 311 and the caps 314 rotatably around its own center axis while its inner peripheral surface can slide along the outer peripheral surfaces of the protrusions 316.

The pressure roller 32 includes a core 321, an elastic layer 322, and a release layer 323. The core 321 is a long thin circular cylinder, for example, some dozens of centimeters long and some millimeters to some dozens of millimeters in diameter, and made of metal such as aluminum, iron, or SUS. The core 321 is supported rotatably around its center axis at its longitudinal ends by bearings, not shown in FIGS. 2A and 2B. These bearings are slidably supported by the frame of the fuser 30 to make the center axis of the core approach the rotation axis of the fuser belt 31 (the negative direction of the X axis in FIGS. 2A and 2B). Although not shown in FIGS. 2A and 2B, both ends of the core 321 are further connected through a torque transmission mechanism such as gears, with a motor, which is, for example, of a brushless direct-current (BLDC) type. Receiving torque from this motor, the pressure roller 32 rotates as a driving roller, which drives rotation of the fuser belt 31 in contact with the pressure roller 32 at the nip NP. The elastic layer 322 is made of highly elastic, heat-resistant resin such as silicone rubber that wraps around the core 321. The release layer 323 is a film of fluorine resin such as PFA that wraps around the elastic layer 322.

The pusher unit 33 includes, for example, a spring 331 and an actuator such as a solenoid or a motor for control of elastic force of the spring 331, not shown in FIGS. 2A and 2B. Using these elements, the pusher unit 33 applies a force fP to both ends of the core 321; the force is directed from the center axis of the core 321 toward the rotation axis of the fuser belt 31 (in the negative direction of the X axis). By this force fP, the outer peripheral surface of the pressure roller 32 is pressed at the nip NP onto the pressure face 315 of the pressure pad 311 with the fuser belt 31 in between; the pressure roller 32 then applies pressure in the order of 106 Pa, for example, to the pressure face 315. Since the pressure pad 311 has negligibly lower elasticity than the pressure roller 32, in particular its elastic layer 322, the outer peripheral surface of the pressure roller 32 deforms into a substantially flat shape at the nip NP. Due to the pressure and deformation of the pressure roller 32, a portion of the sheet SH2 in the nip NP receives sufficient amount of heat from the fuser belt 31, and thus, toner attached to the portion is fixed to the surface of the sheet SH2 without leaving unevenness.

The pusher unit 33 can change the strength of the force fP to any of at least two levels. The higher level of the force fP is, for example, some hundreds of newtons, and used when the sheet SH2 is of plain paper. The lower level of the force fP is, for example, some tens to a hundred and some tens of newtons, and used when the sheet SH2 is of a paper type easier to fold than plain paper such as thin paper and envelopes. When the force fP has the lower level, the nip NP has a width, i.e. a length in the Y-axis direction in FIGS. 2A and 2B, reduced to a fraction of the width when the force fP has the higher level. In response to a decrease in heating area caused by the reduction in width of the nip NP, the rotation of the pressure roller 32 decreases its speed, or the heater unit 313 increases a heat amount of the halogen heater. Accordingly, the sheet SH2 passing through the nip NP reliably receives a heat amount necessary for fixing of toner regardless of the strength of the force fP.

Figure 3A:
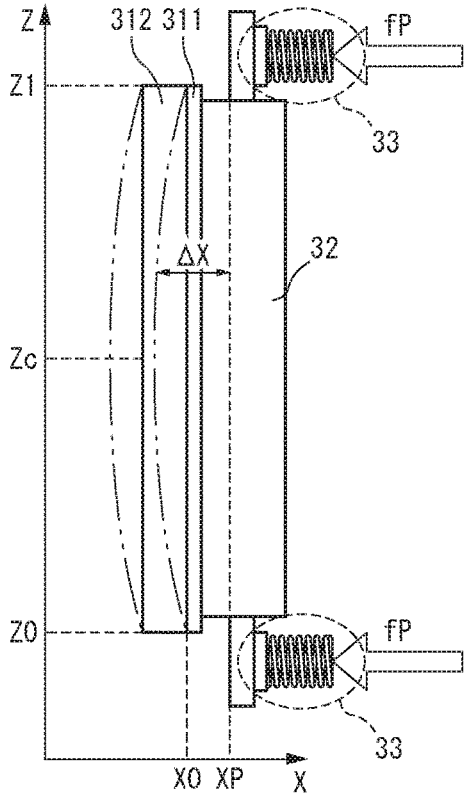
FIG. 3A is a schematic top view of the holding member, pressure pad, and pressure roller shown in FIGS. 2A, 2B.

Variation of Nip Pressure Due to Deflection of Holding Member and Pressure Roller FIG. 3A is a schematic top view of the holding member 312, pressure pad 311, and pressure roller 32. By the force fP of the pusher unit 33, the pressure roller 32 is pressed against the pressure pad 311 with the fuser belt 31 in between. Since both longitudinal edges, (both points with the coordinates Z=0 and 1 on the Z axis shown in FIG. 3A) of the holding member 312 are fixed on the frame of the fuser 30, the holding member then bends such that its portion farther from both the ends is positioned at a larger distance from the outer peripheral surface of the pressure roller 32, i.e. the center portion (the coordinate Z=Zc and its vicinity in FIG. 3A) expands in the direction of the force fP (in the negative direction of the X axis in FIG. 3A). An amount of the deflection is typically in the order of one or ten micrometers, and calculable by, for example, assuming that the holding member 312 is a double-supported beam.

Not shown in FIG. 3A, the core 321 of the pressure roller 32 also bends due to reaction to the force fP from the pressure pad 311 such that the portion farther from both the longitudinal (Z-axis) ends, Z=0 and 1, and nearer to the center portion Z=Zc is positioned at a larger distance from the pressure roller 32. An amount of the deflection is, in general, sufficiently smaller than that of the holding member 312.

Figure 3B:
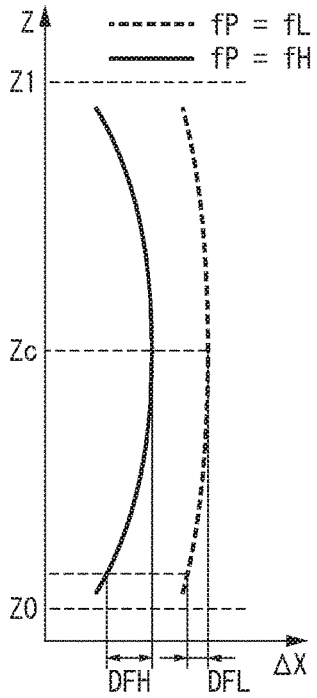
FIG. 3B shows graphs showing the relationship between the longitudinal coordinates Z of the holding member and the distances ΔX from the holding member to the core of the pressure roller.

FIG. 3B shows graphs showing the relationship between the longitudinal coordinates Z of the holding member 312 and the distance ΔX from the holding member 312 to the core 321 of the pressure roller 32. A broken-line graph shows the relationship when the force fP of the pusher unit 33 has a lower strength level fL, and a solid-line graph shows the relationship when the force fP has a higher strength level fH>fL. As is shown in these graphs, the center portion Z=Zc of the holding member 312 is located at a distance ΔX from the core 321 larger than both the end portions Z=Z0, Z1 of the holding member 312. By the difference of the distances ΔX between either of the end portions Z=Z0, Z1 and the center portion Z=Zc, a deflection amount of the holding member 312 is evaluated; more properly, this deflection amount is measured with reference to the core 321, and thus includes an amount of deflection of the core 321. When the force fP has the lower strength level fL, the deflection amount DFL of the holding member 312 is small, and when the force fP has the higher strength level fH, the deflection amount DFH is large: DFL<DFH.

Figure 3C:
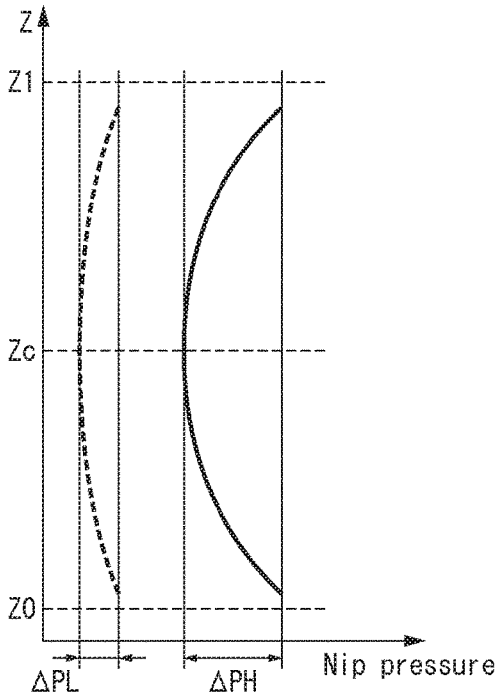
FIG. 3C shows graphs showing distribution of nip pressure between the holding member and the outer peripheral surface of the pressure roller, which would appear in the longitudinal direction of the holding member if the pressure pad were a uniform cuboid and the pressure face were a flat face parallel to the Y-Z plane.

FIG. 3C shows graphs showing distribution of nip pressure between the holding member 312 and the outer peripheral surface of the pressure roller 32, which would appear in the longitudinal direction of the holding member 312 if the pressure pad 311 were a uniform cuboid and the pressure face 315 were a flat face parallel to the Y-Z plane. A broken-line graph shows the distribution when the force fP of the pusher unit 33 has the lower strength level fL, and a solid-line graph shows the distribution when the force fP has the higher strength level fH. As is shown in these graphs, the center portion Z=Zc of the holding member 312 is subjected to stress in the direction apart from the pressure roller 32 due to the deflection of the holding member 312, and thus, a lower nip pressure is applied to the center portion than to both the end portions Z=Z0, Z1 of the holding member 312. The difference in nip pressure between the center portion Z=Zc and the end portions Z=Z0, Z1 is equal to a smaller value ΔPL when the force fP has the lower strength level fL, and a larger value ΔPH when the force fP has the higher strength level fH: ΔPL<ΔPH.

As long as the pressure pad 311 has such a simple structure as the uniform cuboid assumed in FIG. 3C, the risk of uneven toner fixing and paper wrinkling caused by the large difference ΔPH in nip pressure cannot be ignored especially when the force fP of the pusher unit 33 has the higher strength level fH. In order to merely remove the risk, for example, only the center portion Z=Zc of the pressure face 315 would have to be risen with respect to both the end portions Z=Z0, Z1 and positioned nearer to the pressure roller 32 (see, e.g. JP 2013-160910, JP 2013-195991, and JP 2014-178555), since the rising of the center portion Z=Zc would compensate for the increase in the distance ΔX from the pressure roller 32 caused by the deflection of the holding member 312, thus increasing nip pressure in the center portion to a level equal to nip pressure in the end portions Z=Z0, Z1 plus the difference ΔPH. However, this technique alone could not prevent nip pressure in the center portion Z=Zc from exceeding nip pressure in the end portions Z=Z0, Z1 when the force fP has the lower strength level fL (since ΔPL<ΔPH), and thus could provide another cause of uneven toner fixing and paper wrinkling.

Three Dimensional Shape of Pressure Face

When the pressure pad 311 according to the embodiment of the invention is apart from the nip to be formed with the pressure roller 32 due to removal of the force fP of the pusher unit 33, the pressure face 315 has a three-dimensional shape as described below. This shape enables, when the pressure pad 311 forms the nip, variation in nip pressure entailed by the undulation of the pressure face 315 to compensate for variation in nip pressure caused by the deflection of the holding member 312, regardless of whether the force fP has the lower strength level fL or the higher one fH.

Figure 4A:
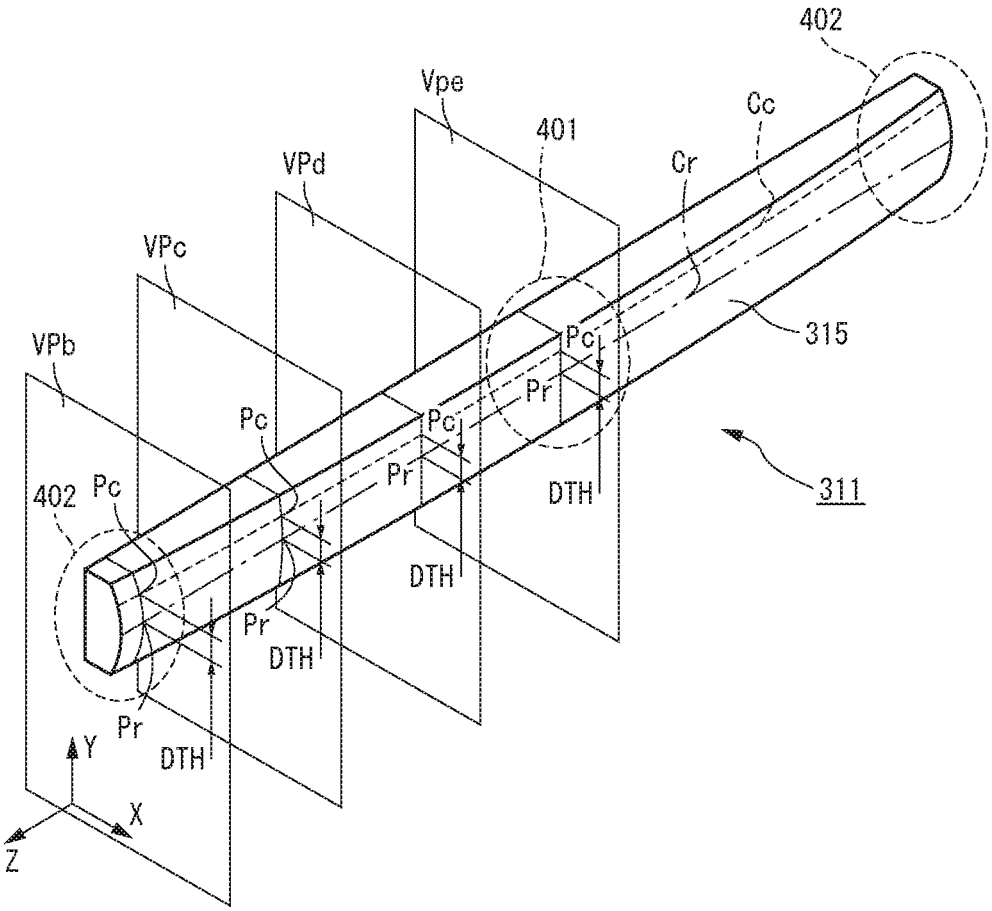
FIG. 4A is a perspective view showing an appearance of the pressure pad from a viewpoint where the entirety of the pressure face is visible.

FIG. 4A is a perspective view showing an appearance of the pressure pad 311 from a viewpoint where the entirety of the pressure face 315 is visible. FIG. 4A exaggerates the size of concave and convex portions of the pressure face 315, which is typically in the order of micrometers to tens of micrometers, with respect to the length of each side of the pressure face 315, which is typically in the order of one millimeter or more. The three-dimensional shape of the pressure face 315 is designed as a shape similar to a "ryuko (in Japanese)," which is the top face of a "koto," i.e. a Japanese harp, and includes strings stretched thereover. In particular, the pressure pad 311 has, in its longitudinal direction, a flat center portion 401 and convex end portions 402.

Figures 4B, 4C, 4D, 4E:
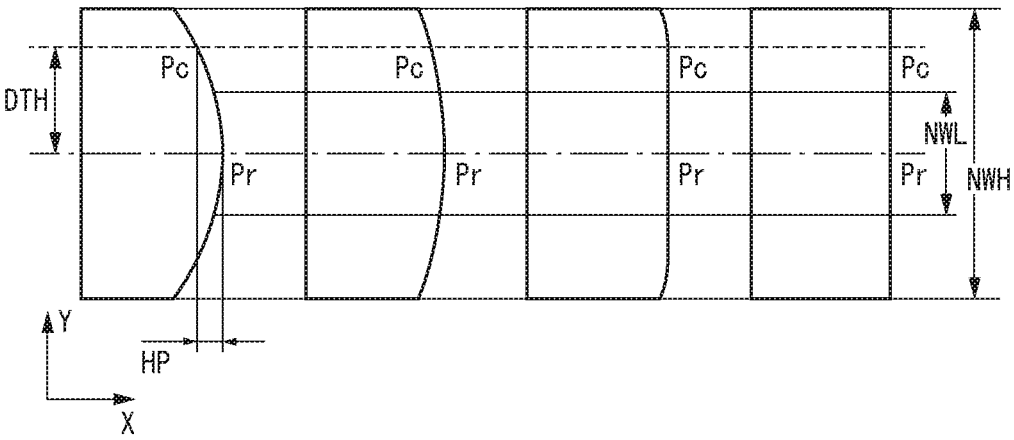
FIGS. 4B, 4C, 4D, and 4E are views of cross sections of the pressure pad shown in FIG. 4A that are intersections with virtual planes VPb, VPc, VPd, and VPe, respectively, normal to the longitudinal direction (the Z-axis direction in FIGS. 4B-4D)

FIGS. 4B, 4C, 4D, and 4E are views of cross sections of the pressure pad 311 shown in FIG. 4A that are intersections with virtual planes VPb, VPc, VPd, and VPe, respectively, normal to the longitudinal direction (the Z-axis direction in FIGS. 4B-4D). As shown in FIG. 4B, in the first virtual plane VPb cutting one of the end portions 402 of the pressure pad 311, the pressure face 315 has a profile, i.e. an intersection curve between the first virtual plane VPb and the pressure face 315, which is drawn as a smooth, convex curve such as a circular arc protruding in the opposite direction to the direction of the force fP of the pusher unit 33 (the X-axis direction in FIGS. 4B-4D), i.e. towards the pressure roller 32. As shown in FIGS. 4C and 4D, in the second and third virtual planes VPc and VPd cutting intermediate portions between one of the end portions 402 and center portion 401 of the pressure pad 311, the pressure face 315 also has profiles of shapes similar to the convex curve; one of the shapes has a lower average curvature, i.e. it is a more nearly straight line, in one of the virtual planes nearer to the center portion 401 of the pressure pad 311. As shown in FIG. 4E, in the fourth virtual plane VPe cutting the center portion 401 of the pressure pad 311, the pressure face 315 has a profile of the same shape as a straight line normal to the direction of the force fP (the X-axis direction in FIG. 4E), i.e. extending in the width direction of the nip (the Y-axis direction in FIG. 4E).

—Reference Section on Pressure Face—

The profiles of the pressure face 315 in the virtual planes VPb-VPe have their respective point-like areas Pr, which are hereinafter referred to as "reference points." The reference point Pr of each profile is the first to come into contact with the outer peripheral surface of the pressure roller 32 with the fuser belt 31 in between when the nip is formed, i.e. the nearest to the outer peripheral surface of the pressure roller 32.

Figure 5A:
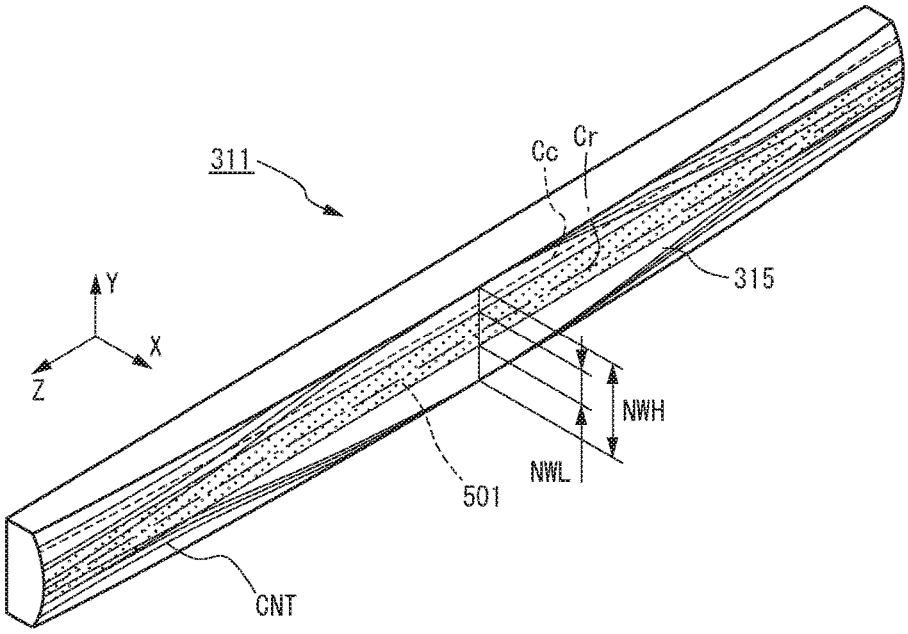
FIG. 5A is a perspective view of the pressure face shown in FIG. 4A with contours.

FIG. 5A is a perspective view of the pressure face 315 shown in FIG. 4A with contours CNT. Each contour CNT represents regions at the same location in the direction of the force fP (regions of the same X coordinate in FIG. 5A), i.e. an intersection curve between a virtual plane normal to the direction (the X-axis direction) and the pressure face 315. As is clear from these contours CNT, in any of the virtual planes VPb-VPe, the reference point Pr of the profile of the pressure face 315 is located at the minimum distance from the rotation axis of the pressure roller 32. Accordingly, the reference point Pr is the nearest to the outer peripheral surface of the pressure roller 32, and thus, the first to come into contact with the outer peripheral surface of the pressure roller 32 with the fuser belt 31 in between when the nip is formed.

Figure 5B:
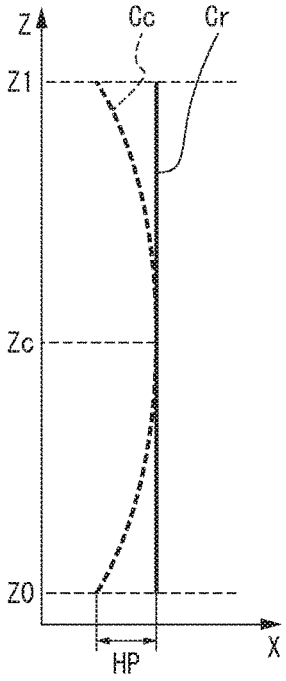
FIG. 5B is a cross-sectional view of the pressure face showing its profile in a virtual plane normal to the width direction of the nip (the Y-axis direction)

FIG. 5B is a cross-sectional view of the pressure face 315 showing its profile in a virtual plane normal to the width direction of the nip (the Y-axis direction). A solid curve Cr shows the profile of the pressure face 315 when the virtual plane includes both the rotation axes of the fuser belt 31 and pressure roller 32. This profile Cr is equivalent to a linear area on the pressure face 315 on which the rotation axis of the pressure roller 32 is projected in the direction of the force fP (the negative direction of the X axis), and includes all the reference points Pr. This profile Cr is hereinafter referred to as a "reference line." In the example shown in FIG. 5B, the reference line Cr is a straight line parallel to the longitudinal direction of the pressure pad 311 (the Z-axis direction). In the other words, any reference point Pr is located at the same distance from the outer peripheral surface of the pressure roller 32. In this case, the entirety of the reference line Cr is always included in the nip, regardless of the strength of the force fP.

With increase in strength of the force fP, an area in the pressure face 315 included in the nip spreads around the reference line Cr in the width direction (the Y-axis direction). A dotted area 501 shown in FIG. 5A represents the area in the pressure face 315 included in the nip when the force fP has the lower strength level fL. This area 501 ranges from the reference line Cr to substantially the same distance (half the nip width NWL) on both sides of the reference line Cr in the width direction (the Y-axis direction). Accordingly, the nip width is substantially equal to the maximum width NWH of the pressure face 315.

Since the pressure pad 311 has an elasticity significantly lower than the outer peripheral surface of the pressure roller 32 has, i.e. the pad is so hard that its deformation is negligible, the nip has substantially the same shape as the pressure face 315. Especially on the reference line Cr and its vicinity, the nip is shaped as a substantial plane, as is understood from FIGS. 4A, 4E, 5A, and 5B. Since the reference line Cr is always included in the nip regardless of the strength of the force fP, the planar shape of the nip around the reference line Cr is independent of the strength of the force fP. In the center portion 401 of the pressure pad 311 in its longitudinal direction, as shown in FIG. 4E, the nip spreads as a plane parallel to the width (Y-axis) direction, regardless of the difference between the nip widths NWL, NWH depending on the strength of the force fP.

—Boundary Section on Pressure Face—

FIGS. 4A-4E further show boundary points Pc included in the profiles of the pressure face 315 in the virtual planes VPb-VPe. The term "boundary point" Pc means a point-like area on each profile at a threshold distance DTH in the width (Y-axis) direction of the nip from the reference point Pr on the same profile. The term "threshold distance" DTH means a distance from the reference line Cr to the edge of the nip in the width (Y-axis) direction, i.e. half the nip width, when the force fP of the pusher unit 33 has a strength equal to a threshold level fTH. Since the threshold level fTH is a level intermediate between the lower strength level fL and higher one fH, twice of the threshold distance DTH is longer than the nip width NWL under load of the lower strength level fL, and shorter than the nip width NWH under load of the higher strength level fH: NWL<2 DTH<NWH. Accordingly, like a broken line Cc shown in FIG. 5A, a linear area on the pressure face 315 consisting of all the boundary points Pc, which is hereinafter referred to as "boundary line," is located on the outer side of the area 501 on the pressure face 315 included in the nip under load of the lower strength level fL. The boundary line Cc and the area outside it on the pressure face 315 are not included in the nip when the force fP of the pusher unit 33 has the lower strength level fL, but they are included in the nip when the force fP has the higher strength level fH.

The broken line Cc shown in FIG. 5B shows a profile of the pressure face 315 in a virtual plane that is normal to the width (Y-axis) direction of the nip and located at the threshold distance DTH in the width (Y-axis) direction of the nip from the reference line Cr on the pressure face 315, i.e. it shows a boundary line. With increasing distance from the center portion 401 of the pressure pad 311 in its longitudinal (Z-axis) direction, the boundary line Cc bends away from the pressure roller 32 in the direction of the force fP (the negative direction of the X axis), and the pressure face 315 has a lower average curvature along a virtual plane normal to the longitudinal (Z-axis) direction. Accordingly, the first virtual plane VPb cutting the end portion 402 of the pressure pad 311 (see FIG. 4B) has the reference point Pr at the same position as the fourth virtual plane VPe cutting the center portion 401 of the pressure pad 311 (see FIG. 4E), while the first virtual plane VPb has the boundary point Pc, relative to that of the fourth virtual plane VPe, displaced in the opposite direction to the direction of the pressure roller 32 (to the negative direction of the X axis). In the other words, relative to the reference point Pr, the boundary point Pc is displaced in the opposite direction to the direction of the pressure roller 32 (to the negative direction of the X axis). Preferably in each of the end portions 402, the distance HP in the direction of the force fP (the X-axis direction) from the reference point Pr to the boundary point Pc is designed to be equal to or larger than half the amount DFH of deflection of the holding member 312 relative to the rotation axis of the pressure roller 32 when the force fP has the higher strength level fH (see FIG. 3B): HP≥DFH/2.

Since the pressure pad 311 is harder than the outer peripheral surface of the pressure roller 32, the nip has substantially the same shape as the pressure face 315 has. In the virtual planes VPb-VPe shown in FIG. 4A, the nip accordingly extends along the profiles of the pressure face 315 shown in FIGS. 4B-4E. As is understood from these profiles, when the force fP has the lower strength level fL, the nip width NWL is so narrow that the nip spreads in both the end portions 402 on substantially the same plane as in the central portion 401. As a result, in both the end portions 402 and the central portion 401, the nip has a substantially constant ratio of an area at the same position in the direction of the force fP (i.e. an area of the same X coordinate) as that of the reference line Cr. On the other hand, when the force fP has the higher strength level fH, the nip width NWH reaches the maximum width of the pressure face 315, and thus the nip in both the end portions 402 has edges in the width direction curved away in the direction of the force fP (the negative direction of the X axis) from the center, unlike the nip in the central portion 401. As a result, the nip in both the end portions 402 has a higher ratio of an area on the opposite side of the reference line Cr from the pressure roller 32 in the direction of the force fP (i.e. an area of X coordinates smaller than that of the reference line Cr) than the nip in the central portion 401. The above-described deformation of the nip depending on the strength of the force fP affects nip pressure distribution in the direction of the rotation axis of the pressure roller 32 (the Z-axis direction) as follows.

Figure 5C:
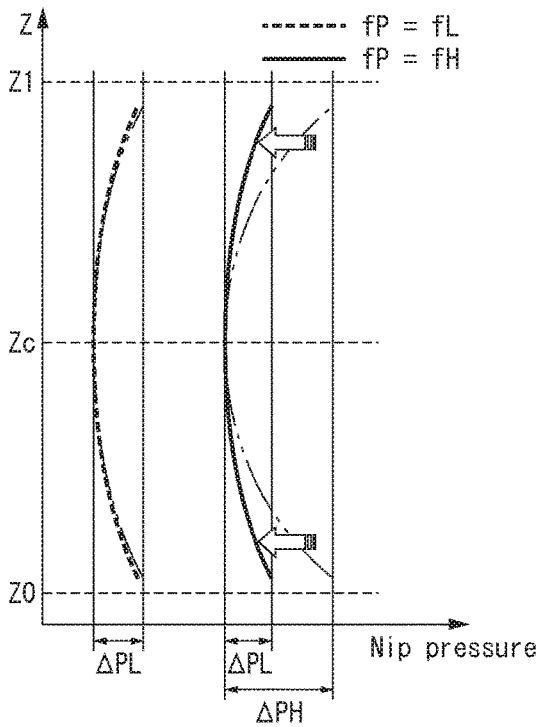
FIG. 5C shows graphs of actual distribution of nip pressure in the direction of the rotation axis of the pressure roller (the Z-axis direction)

FIG. 5C shows graphs of actual distribution of nip pressure in the direction of the rotation axis of the pressure roller 32 (the Z-axis direction). A broken-line graph shows the distribution when the force fP of the pusher unit 33 has the lower strength level fL, and a solid-line graph shows the distribution when the force fP has the higher strength level fH. A chain-double-dashed-line graph shows the distribution under the assumption that the entirety of the pressure face 315 is a plane; see FIG. 3C.

As shown in these graphs, the distribution when the force fP has the lower strength level fL is substantially the same as the distribution under the assumption that the entirety of the pressure face 315 is a plane, and in particular, both the distributions have substantially the same difference ΔPL in nip pressure between each of the end portions Z=Z0, Z1 and the center portion Z=Zc. This is because the area 501 of the pressure face 315 included in the nip shown in FIG. 5A is a substantial plane. Conversely, the boundary lines Cc should be defined to show the maximum range in the pressure face 315 that can be regarded as a plane in terms of the above-mentioned distributions of nip pressure. Since the nip spreads only between the boundary lines Cc when the force fP has a strength lower than the threshold level fTH, the nip pressure distribution is substantially the same as that when the entirety of the pressure face 315 is assumed to be a plane.

In comparison with the nip pressure distribution when the entirety of the pressure face 315 is assumed to be a plane, the nip pressure distribution when the force fP has the higher strength level fH has substantially the same shape in the center portion Z=Zc, but lower values in both the end portions Z=Z0, Z1. Thus, the difference in nip pressure between the center portion Z=Zc and the end portions Z=Z0, Z1 is reduced from the value ΔPH when the entirety of the pressure face 315 is assumed to be a plane, and in particular, substantially equal to the value ΔPL when the force fP has the lower strength level fL. This is for the following reason. Since the nip spreads beyond the boundary lines Cc across the entire width of the pressure face 315, the nip in both the end portions Z=Z0, Z1 is more largely curved in the width direction than the nip in the center portion Z=Zc (see FIGS. 4B, 4E), and has a higher ratio of the area on the opposite side of the reference line Cr from the pressure roller 32 in the direction of the force fP (i.e. the area of X coordinates smaller than that of the reference line Cr) than the nip in the central portion Z=Zc. As a result, reduction in nip pressure caused by the curved shape of the pressure face 315 is larger in both the end portions Z=Z0, Z1 than in the center portion Z=Zc. In particular, the amount of reduction in both the end portions Z=Z0, Z1 caused by the curved shape of the pressure face 315 is similar to that in the center portion Z=Zc caused by the deflection of the holding member 312, and thus, the nip pressure in both the end portions Z=Z0, Z1 approaches the level in the center portion Z=Zc.

Merit of Embodiment

In the printer 100 according to the embodiment of the invention, as described above, the fuser 30 is of a free belt nip type, and the pressure pad 311 uses the pressure face 315 to form the nip between the face and the outer peripheral surface of the pressure roller 32 with the fuser belt 31 in between. When the pressure pad 311 is apart from the nip, the pressure face 315 has such a three-dimensional shape as shown in FIGS. 4A-4E, 5A. Especially in contrast to the fourth virtual plane VPe cutting the center portion 401 of the pressure pad 311 (see FIG. 4E), the first virtual plane VPb cutting either of the end portions 402 of the pressure pad 311 (see FIG. 4B) has the boundary sections Pc, Cc, relative to the reference sections Pr, Cr, displaced in the opposite direction to the direction of the pressure roller 32 (to the negative direction of the X axis. See FIG. 5B).

When the force fP has the lower strength level fL, the nip spreads only between the boundary lines Cc, and thus the entirety of the nip is shaped as a substantial plane. In this case, the deflection of the holding member 312 caused by the force fP is so small that variation in nip pressure in the longitudinal direction of the nip (the Z-axis direction) is sufficiently reduced. When the force fP has the higher strength level fH, the nip spreads beyond the boundary sections Cc across the entire width of the pressure face 315. Accordingly, the nip in both the end portions Z=Z0, Z1 in the longitudinal direction of the nip (the Z-axis direction) has a higher ratio of the area on the opposite side of the reference line Cr from the pressure roller 32 in the direction of the force fP (i.e. the area of X coordinates smaller than that of the reference line Cr) than the nip in the central portion Z=Zc. As a result, reduction in nip pressure caused by the curved shape of the pressure face 315 in its width direction is larger in both the end portions Z=Z0, Z1 than in the center portion Z=Zc. Since the difference in amount of the reduction between both the end portions Z=Z0, Z1 and the center portion Z=Zc compensates for the difference therebetween in nip pressure caused by the deflection of the holding member 312, variation in nip pressure in the longitudinal direction of the nip (the Z-axis direction) is sufficiently reduced, regardless of the strength of the force fP.

Thus, the three-dimensional shape of the pressure face 315 enables nip pressure distribution in the axial direction common between the fuser belt 31 and the pressure roller 32 (the Z-axis direction) to maintain a proper shape even when the fuser 30 changes the force applied to sheets. In particular, the risk of uneven toner fixing and paper wrinkling caused by variation in nip pressure can be reduced regardless of the strength of the force applied to sheets. Therefore, the printer 100 can maintain sufficiently high reliability for high image quality and high operation speed.

Modification (A) The image forming device 100 according to the above-described embodiment of the invention is the electrophotographic color printer. Alternatively, an image forming device according to an embodiment of the invention may be any single-function device, e.g., a monochrome printer, a copier, or a fax machine, or MFP.

(B) The free belt nip structure of the fuser 30 shown in FIGS. 2A, 2B has the belt 31 as a heating member and the roller 32 as a pressing member. Conversely, a roller may be a heating member, and a belt may be a pressing member. In this case, the pusher unit 33 applies the force fP to a pressure pad, instead of the core 321 of the pressure roller 32. The holding member for a pressure pad bends according to a force from a fuser roller as reaction to the force fP; the deflection of the pressure pad causes variation in nip pressure, which is compensated for by variation in nip pressure caused by undulation of the pressure face of the pressure pad.

In place of the free belt 31, a fuser belt may be a belt wrapping around the pressure pad 311 and another pulley. In this case, the heater unit 33 may be built in or arranged around the pulley.

(C) In the structure of the fuser 30 shown in FIGS. 2A, 2B, the holding member 312 is the channel metal plate elongated in the axial direction of the fuser belt 31 (the Z-axis direction). A holding member may be alternatively an angle metal plate, i.e. a metal plate L-shaped in cross section. Although an angle metal plate is generally more deformable than a channel metal plate, the angle metal plate facilitates reduction in weight of the holding member 312 with a fixed area of contact to the pressure pad 311. The pressure pad 311 according to the invention can reduce the variation in nip pressure caused by the deflection of the holding member 312 regardless of the strength of the force fP, and thus, the holding member composed of angle metal plates enables the fuser 30 to have a reduced size.

(D) The heater unit 313 shown in FIGS. 2A, 2B is the halogen heater. The heater unit 33 may be alternatively a ceramic heater, a carbon heater, or an induction heating device (IH).

(E) The pressure face 315 shown in FIGS. 4A-4E, 5A is totally a smoothly curved surface. This is, however, insignificant for a pressure face according to the invention, which only has to have a shape meeting the following condition a, like the shape of the pressure face 315 shown in FIGS. 4A-4E, 5A. Condition a: When the pressure pad 311 is apart from the nip between it and the pressure roller 32 due to removal of the force fP applied by the pusher unit 33, each end portion 402 of the pressure pad 311 has the boundary section Pc, Cc, relative to the reference section Pr, Cr, more largely displaced in the opposite direction to the direction of the pressure roller 32 than the center portion 401 of the pressure pad 311.

—First Modification—

Figure 6A:
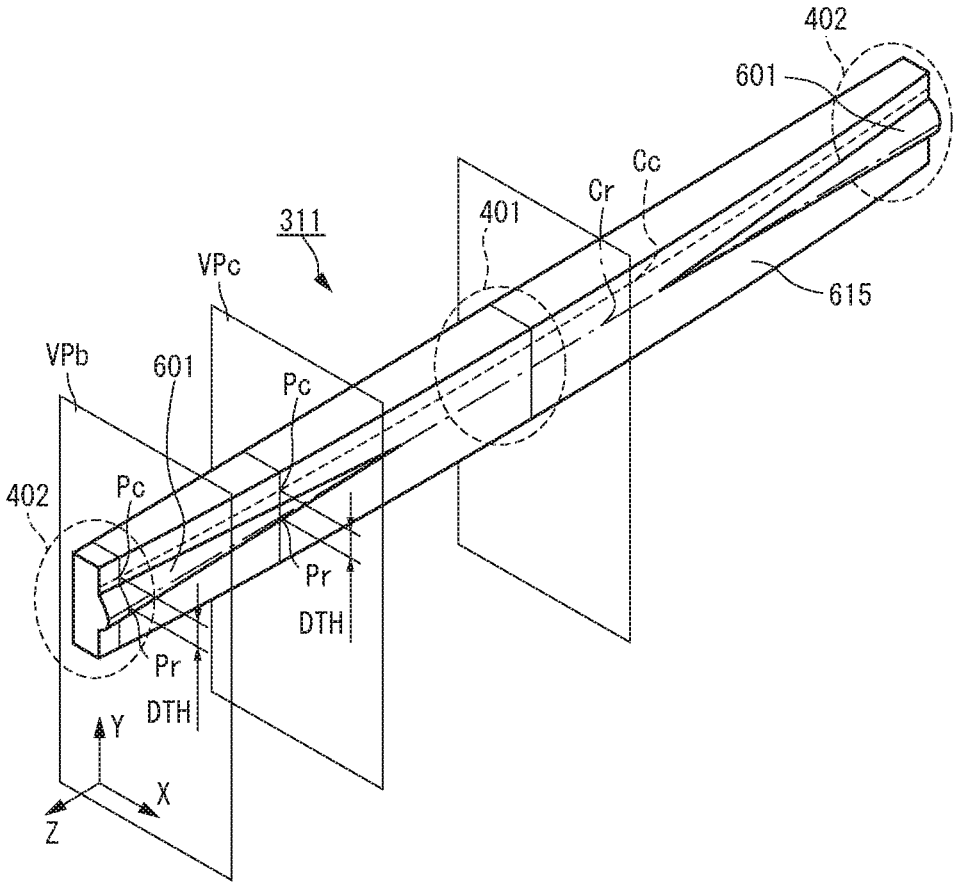
FIG. 6A is a perspective view of the pressure pad including a first modification of the pressure face meeting condition α.

FIG. 6A is a perspective view of the pressure pad 311 including a first modification 615 of the pressure face meeting condition α. Like FIG. 4A, FIG. 6A exaggerates the size of concave and convex portions of the pressure face 615 with respect to the length of each side thereof. The pressure face 615 has, in the longitudinal direction of the pressure pad 311, a flat center portion 401 and its vicinity that is smoothly and more largely displaced in the direction of the force fP with decreasing distance from either of end portions 402. The pressure face 615 further has a convex portion 601 at each of the end portions 402. The convex portion 601 is a protrusion extending from the center portion of the pressure face 615 in the opposite direction to the direction of the force fP (in the positive direction of the X axis), i.e. towards the pressure roller 32. The convex portion 601 includes a ridge Cr extending along the center line of the pressure face 615 in the width (Y-axis) direction of the nip. This ridge Cr is the nearest in the pressure face 615 to the rotation axis of the pressure roller 32, forming the reference line Cr. Also in the example shown in FIG. 6A, the reference line Cr is a straight line parallel to the longitudinal direction of the pressure pad 311 (the Z-axis direction). In other words, any point on the reference line Cr is located at the same distance from the outer peripheral surface of the pressure roller 32. Accordingly, the entirety of the reference line Cr is always included in the nip regardless of the strength of the force fP.

Figures 6B, 6C:
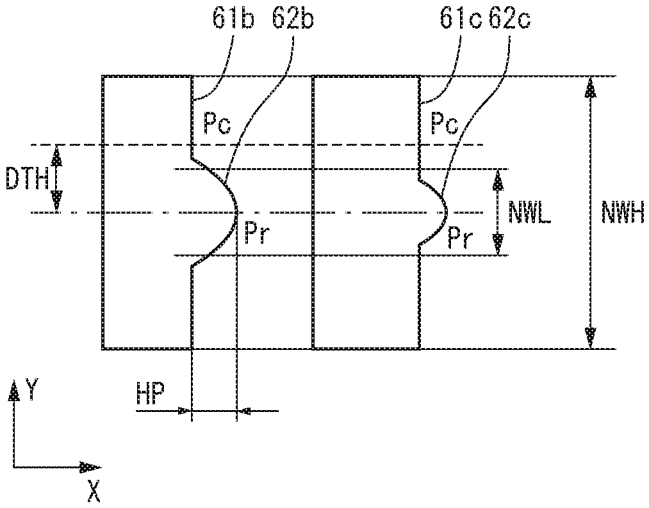
FIGS. 6B and 6C are views of cross sections of the pressure pad that are intersections with virtual planes, respectively, normal to the longitudinal direction (the Z-axis direction in FIGS. 6B, 6C)

FIGS. 6B and 6C are views of cross sections of the pressure pad 311 that are intersections with virtual planes VPb and VPc, respectively, normal to the longitudinal direction (the Z-axis direction in FIGS. 6B, 6C). As shown in FIG. 6B, in a first virtual plane VPb cutting one of the end portions 402 of the pressure pad 311, the pressure face 615 has a profile including, at both edges of the nip in its width (Y-axis) direction, straight lines 61*b* parallel to the width (Y-axis) direction, and at the center of the nip, a smooth, convex curve 62*b*, which is an outline of the convex portion 601 and protrudes in the opposite direction to the direction of the force fP (the positive direction of the X axis). As shown in FIG. 6C, also in a second virtual plane VPc cutting an intermediate portion between one of the end portions 402 and center portion 401 of the pressure pad 311, the pressure face 615 has a profile including straight lines 61*c* at both edges of the nip in its width (Y-axis) direction and a convex curve 62*c* at the center of the nip. In a virtual plane nearer to the center portion 401 of the pressure pad 311, the straight lines 61*b* or 61*c* are nearer to the rotation axis of the pressure roller 32 and the convex curve 62*b* or 62*c* is narrower. In a third virtual plane cutting the center portion 401 of the pressure pad 311, the pressure face 615 has a profile equivalent to a straight line in the width (Y-axis) direction, like in the fourth virtual plane VPe shown in FIG. 4E.

In the virtual planes VPb, VPc, the reference points Pr of the pressure face 615 are located at the peaks of the convex curves 62*b*, 62*c*, while the boundary points Pc are located on the straight lines 61*b*, 61*c*. Accordingly, the nip under load of the lower strength level fL spreads only on the inner side of a boundary line shown as a broken line Cc in FIG. 6A, and in particular, includes only the convex portion 601 at the end portions 402. On the other hand, the nip under load of the higher strength level fH spreads across the entirety of the pressure face 615, and in particular, includes at the end portions 402, in addition to the convex curve 62*b*, the straight lines 61*b* located on both sides of the convex curve. Both the reference line Cr and the boundary line Cc have, in virtual planes normal to the width (Y-axis) direction of the nip, a shape similar to that shown in FIG. 5B. In other words, the reference line Cr is a straight line parallel to the longitudinal (Z-axis) direction of the pressure pad 311; the boundary line Cc is a smooth curve bending away from the pressure roller 32 in the direction of the force fP (the negative direction of the X axis) with increasing distance from the center portion 401 of the pressure pad 311 in the longitudinal (Z-axis) direction. In addition, with decreasing distance from each end portion 402, the convex curve 62*b* or 62*c* of the pressure face 615 is higher relative to the straight lines 61*b* or 61*c*, i.e. the distance from the boundary point Pc to the reference point Pr in the direction of the force fP (the difference in X coordinate) increases. Hence, the first virtual plane VPb cutting the end portion 402 of the pressure pad 311 (see FIG. 6B) has the boundary point Pc that is, relative to the reference point Pr, more largely displaced in the opposite direction to the direction of the pressure roller 32 (to the negative direction of the X axis) than the fourth virtual plane VPe cutting the center portion 401 of the pressure pad 311 (see FIG. 4E). Preferably in each of the end portions 402, the distance HP in the (X-axis) direction of the force fP from the reference point Pr to the boundary point Pc (the difference in X coordinate), i.e. the height of the peak of the convex curve 62*b* relative to the straight lines 61*b*, is designed to be equal to or larger than half the amount DFH of deflection of the holding member 312 relative to the rotation axis of the pressure roller 32 when the force fP has the higher strength level fH (see FIG. 3B): HP≥DFH/2.

Since elastic deformation of the pressure pad 311 is negligible in comparison to that of the outer peripheral surface of the pressure roller 32, the nip has substantially the same shape as the pressure face 615. When the force fP has the lower strength level fL, the nip width NWL is so narrow that the nip includes only the convex portion 601 at both the end portions 402. As a result, like the nip in the central portion 401, the nip in both the end portions 402 has only a negligible ratio of an area farther from the pressure roller 32 in the direction of the force fP (i.e. an area of a smaller X coordinate) than the reference line Cr. Thus, the nip pressure distribution is substantially the same as the distribution under the assumption that the entirety of the pressure face is a plane (see FIG. 5C). On the other hand, when the force fP has the higher strength level fH, the nip width NWH reaches the maximum width of the pressure face 615, and thus the nip in both the end portions 402 has edges in the width direction curved away in the direction of the force fP (the negative direction of the X axis) from the center, unlike the nip in the central portion 401. As a result, in contrast to the nip in the central portion 401, the nip in both the end portions 402 has a non-negligible ratio of an area farther from the pressure roller 32 in the direction of the force fP (i.e. an area of smaller X coordinate) than the reference line Cr. Therefore, the nip pressure in both the end portions Z=Z0, Z1 decreases and the difference in nip pressure between the end portions and the center portion Z=Zc is reduced, in comparison to those when the entirety of the pressure face is assumed to be a plane (see FIG. 5C).

—Second Modification—

Figure 7A:
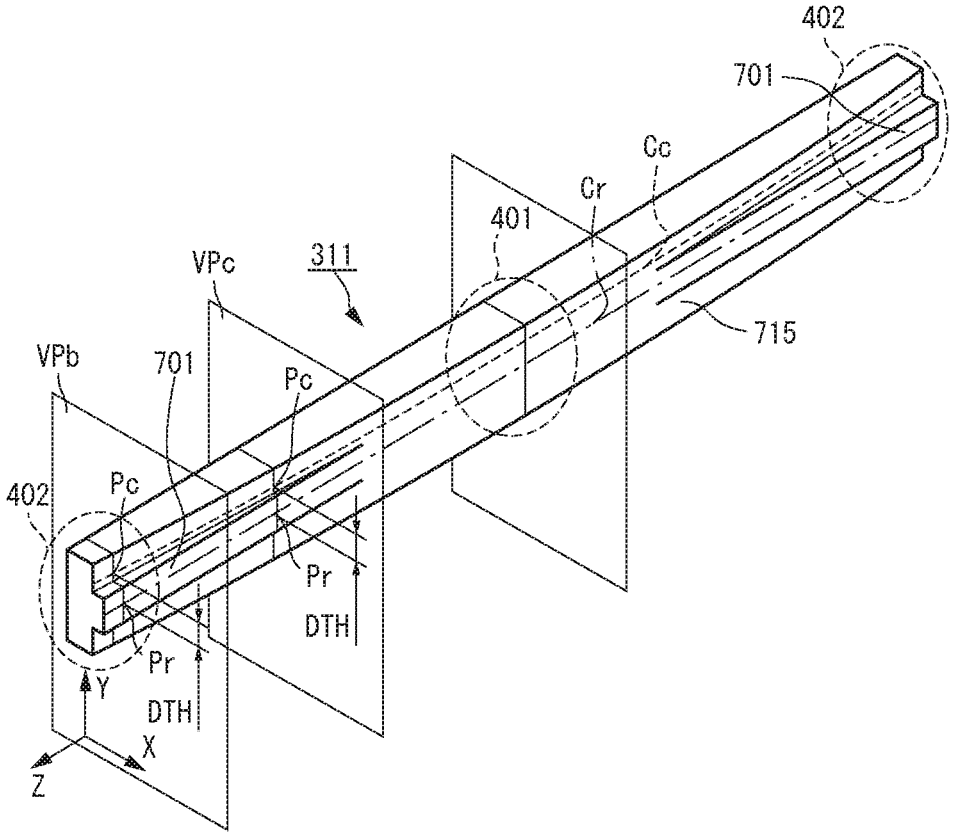
FIG. 7A is a perspective view of the pressure pad including a second modification of the pressure face meeting condition α.

FIG. 7A is a perspective view of the pressure pad 311 including a second modification 715 of the pressure face meeting condition α. Like FIG. 4A, FIG. 7A exaggerates the size of concave and convex portions of the pressure face 715 with respect to the length of each side thereof. The second modification 715 of the pressure face differs from the first modification 615 only in presence of a stepped convex portion 701 in place of the smoothly curved convex portion 601. This stepped convex portion 701 is a protrusion extending in the opposite direction to the direction of the force fP from the center portion of the pressure surface 715 in the width (Y-axis) direction of the nip. The top of the convex portion 701 is a plane normal to the direction of the force fP (the X-axis direction) and including a reference line Cr. In other words, any point on the top of the convex portion 701 is located at the same distance from the outer peripheral surface of the pressure roller 32. Accordingly, the entirety of the reference line Cr is always included in the nip regardless of the strength of the force fP.

Figures 7B, 7C:
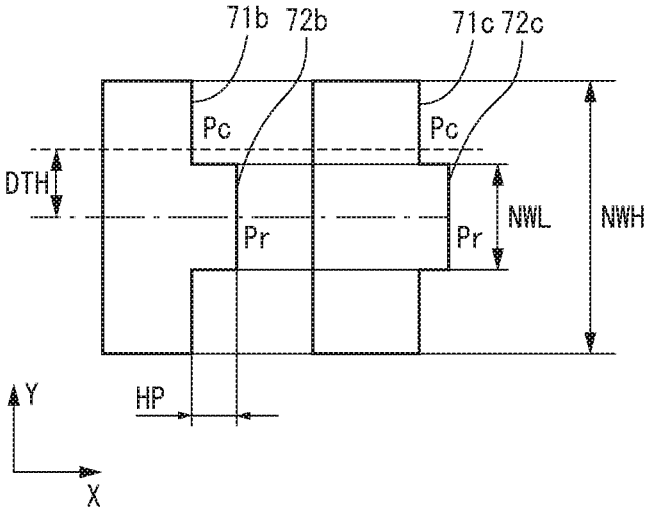
FIGS. 7B and 7C are views of cross sections of the pressure pad that are intersections with virtual planes, respectively, normal to the longitudinal (Z-axis) direction.

FIGS. 7B and 7C are views of cross sections of the pressure pad 311 that are intersections with virtual planes VPb and VPc, respectively, normal to the longitudinal (Z-axis) direction. As shown in FIG. 7B, in a first virtual plane VPb cutting one of the end portions 402 of the pressure pad 311, the pressure face 715 has a profile including, at both edges of the nip in its width (Y-axis) direction, straight lines 71*b* parallel to the width (Y-axis) direction, and at the center of the nip, a box-shaped section 72*b*, which is an outline of the convex portion 701. As shown in FIG. 7C, also in a second virtual plane VPc cutting an intermediate portion between one of the end portions 402 and center portion 401 of the pressure pad 311, the pressure face 715 has a profile including straight lines 71*c* at both edges of the nip in its width (Y-axis) direction and a box-shaped section 72*c* at the center of the nip. In a virtual plane nearer to the center portion 401 of the pressure pad 311, the straight lines 71*b* or 71*c* are nearer to the rotation axis of the pressure roller 32. In a third virtual plane cutting the center portion 401 of the pressure pad 311, the pressure face 715 has a profile equivalent to a straight line in the width (Y-axis) direction, like in the fourth virtual plane VPe shown in FIG. 4E.

In the virtual planes VPb, VPc, the reference points Pr of the pressure face 715 are located at the center of the box-shaped section 72*b*, 72*c*, while the boundary points Pc are located on the straight lines 71*b*, 71*c*. Accordingly, the nip under load of the lower strength level fL spreads only on the inner side of a boundary line shown as a broken line Cc in FIG. 7A, and in particular, includes only the convex portion 701 at the end portions 402. On the other hand, the nip under load of the higher strength level fH spreads across the entirety of the pressure face 715, and in particular, includes at the end portions 402, in addition to the box-shaped section 72*b*, the straight lines 71*b* located on both sides of the box-shaped section. Both the reference line Cr and the boundary line Cc have, in virtual planes normal to the width (Y-axis) direction of the nip, a shape similar to that shown in FIG. 5B. In particular, the first virtual plane VPb cutting one of the end portions 402 of the pressure pad 311 (see FIG. 7B) has the boundary point Pc that is, relative to the reference point Pr, more largely displaced in the opposite direction to the direction of the pressure roller 32 (to the negative direction of the X axis) than the fourth virtual plane VPe cutting the center portion 401 of the pressure pad 311 (see FIG. 4E). Preferably in each of the end portions 402, the distance HP in the (X-axis) direction of the force fP from the reference point Pr to the boundary point Pc (the difference in X coordinate), i.e. the height of the box-shaped section 72*b* relative to the straight lines 71*b*, is designed to be equal to or larger than half the amount DFH of deflection of the holding member 312 relative to the rotation axis of the pressure roller 32 when the force fP has the higher strength level fH (see FIG. 3B): HP≥DFH/2.

When the force fP has the lower strength level fL, the nip width NWL is so narrow that the nip includes only the convex portion 701 at both the end portions 402. As a result, the nip spreads in both the end portions 402 on substantially the same plane as in the central portion 401, and thus, the nip pressure distribution is substantially the same as the distribution under the assumption that the entirety of the pressure face is a plane (see FIG. 5C). On the other hand, when the force fP has the higher strength level fH, the nip width NWH reaches the maximum width of the pressure face 715, and thus, the nip in both the end portions 402 has edges in the width direction curved away in the direction of the force fP (the negative direction of the X axis) from the center, unlike the nip in the central portion 401. As a result, in contrast to the nip in the central portion 401, the nip in both the end portions 402 has a non-negligible ratio of an area farther from the pressure roller 32 in the direction of the force fP (i.e. an area of smaller X coordinate) than the reference line Cr. Therefore, the nip pressure in both the end portions Z=Z0, Z1 decreases and the difference in nip pressure between the end portions and the center portion Z=Zc is reduced, in comparison to when the entirety of the pressure face is assumed to be a plane (see FIG. 5C).

(F) The pressure face 315 shown in FIG. 4E has the same substantially straight line parallel to the width (Y-axis) direction of the nip as the profile in the fourth virtual plane VPe cutting the center portion 401 of the pressure pad 311. This profile may be alternatively a curve; for example, the curve may have substantially the same shape as a portion of the outer peripheral surface of the pressure roller 32 or a portion of the fuser belt 31 in the nip.

—Curve with the Same Shape as Outer Peripheral Surface of Pressure Roller—

Figure 8A:
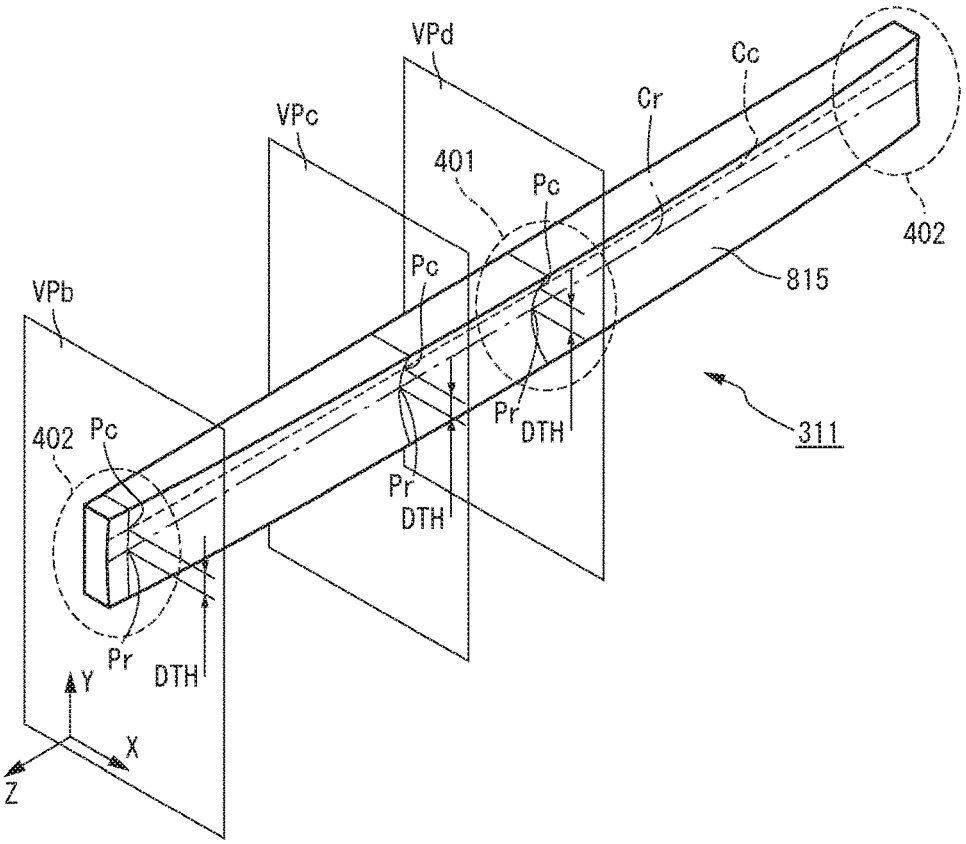
FIG. 8A is a perspective view of the pressure pad including a third modification of the pressure face.
Figures 8B, 8C, 8D:
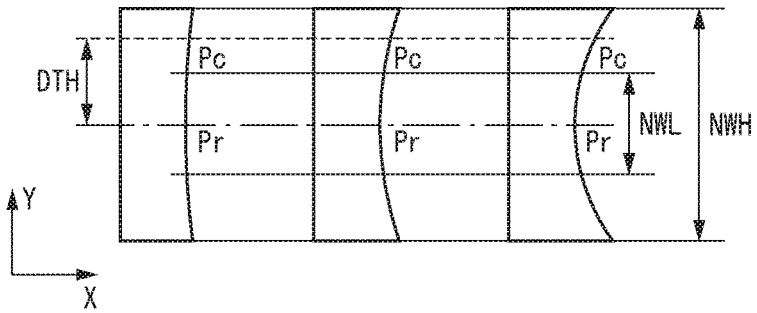
FIGS. 8B, 8C, and 8D are views of cross sections of the pressure pad that are intersections with virtual planes, respectively, normal to the longitudinal direction (the Z-axis direction)

FIG. 8A is a perspective view of the pressure pad 311 including a third modification 815 of the pressure face. FIGS. 8B, 8C, and 8D are views of cross sections of this pressure pad 311 that are intersections with virtual planes VPb, VPc, and VPd, respectively, normal to the longitudinal direction (the Z-axis direction). Like FIGS. 4A-E, FIGS. 8A-8E exaggerate the size of concave and convex portions of the pressure face 815 with respect to the length of each side thereof. As shown in FIGS. 8A-8D, the pressure face 815 has a profile with an arc-shaped concavity in each cross section of the pressure pad 311. Especially in the center portion 401 of the pressure pad 311 in its longitudinal direction (the Z-axis direction in FIG. 8A), the concavity has substantially the same shape as a portion of the outer peripheral surface of the pressure roller 32, i.e. the arc of the concavity in the width (Y-axis) direction of the nip has the same radius as the outer radius of the pressure roller 32. As shown in FIGS. 8B-8D, the arc of the concavity has a larger radius, and is more similar to a straight line, with increasing distance from the center portion 401 in the longitudinal (Z-axis) direction of the pressure pad 311. Thus, both edges of the nip in the width (Y-axis) direction are displaced in the direction of the force fP (the negative direction of the X axis).

The reference point Pr on each arc, i.e. the section of the arc to first come into contact with the outer peripheral surface of the pressure roller 32 with the fuser belt 31 in between when the nip is formed, is located at the largest distance from the rotation axis of the pressure roller 32 (the smallest X coordinate in FIGS. 8A-8D), i.e. at the deepest portion of the concavity. Also in the example shown in FIG. 8A, the reference line Cr is a straight line parallel to the longitudinal (Z-axis) direction of the pressure pad 311. In other words, any point on the reference line Cr is located at the same distance from the outer peripheral surface of the pressure roller 32. Accordingly, the entirety of the reference line Cr is always included in the nip, regardless of the strength of the force fP.

The arc with a larger radius has the boundary point Pc located at the larger distance from the pressure roller 32 in the (X-axis) direction of the force fP. Accordingly, the boundary line Cc bends away from the pressure roller 32 in the direction of the force fP (the negative direction of the X axis) with increasing distance from the center portion 401 of the pressure pad 311 in the longitudinal (Z-axis) direction. This entails, as shown in FIGS. 8B-8D, the boundary point Pc that is, relative to the reference point Pr, more largely displaced in the opposite direction to the direction of the pressure roller 32 (the negative direction of the X axis, i.e. the boundary point Pc that has a larger negative X coordinate when the reference point Pr is located at the origin of the X axis) with increasing distance from the center portion 401 in the longitudinal (Z-axis) direction.

Among points of each arc on the inner side of the boundary point Pc, differences in distance from the rotation axis of the pressure roller 32 are sufficiently small. Since elastic deformation of the pressure pad 311 is negligible in comparison to that of the outer peripheral surface of the pressure roller 32, the nip has substantially the same shape as the pressure face 815, and thus, the nip under load of the lower strength level fL spreads only on the inner side of the boundary line Cc. Accordingly, like the nip in the central portion 401, the nip in both the end portions 402 has only a negligible ratio of an area farther from the pressure roller 32 in the direction of the force fP than the reference line Cr. As a result, the nip pressure distribution is substantially the same as the distribution when the entirety of the pressure face has the same shape as that of the outer peripheral surface of the pressure roller 32. On the other hand, the nip under load of the higher strength level fH spreads across the maximum width of the pressure face 815, and thus, the nip in both the end portions 402 has edges in the width direction curved away in the direction of the force fP (the negative direction of the X axis) from the center, unlike the nip in the central portion 401. As a result, in contrast to the nip in the central portion 401, the nip in both the end portions 402 has a non-negligible ratio of an area farther from the rotation axis of the pressure roller 32 than the reference line Cr. Therefore, the nip pressure in both the end portions 402 decreases and the difference in nip pressure between the end portions and the center portion 401 is reduced, in comparison to the nip pressure distribution when the entirety of the pressure face has the same shape as that of the outer peripheral surface of the pressure roller 32.

Figure 8E:
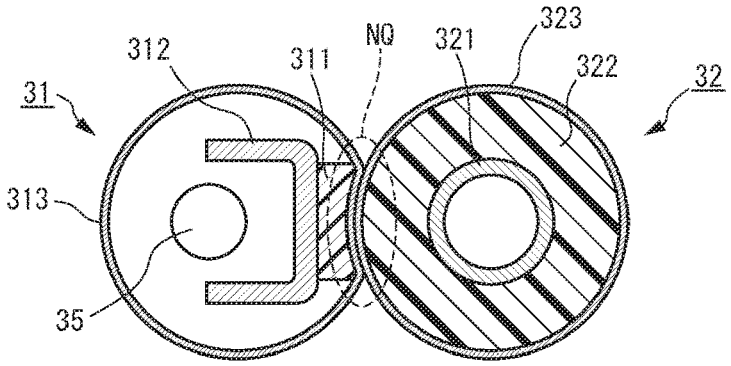
FIG. 8E is a cross-sectional view of the fuser belt and pressure roller showing the nip formed by the center portion of the pressure pad in its longitudinal direction along with the outer peripheral surface of the pressure roller.

FIG. 8E is a cross-sectional view of the fuser belt 31 and pressure roller 32 showing the nip NQ formed by the center portion 401 of the pressure pad 311 in its longitudinal direction along with the outer peripheral surface of the pressure roller 32. In the center portion 401, the pressure face 815 has the same shape as that of the outer peripheral surface of the pressure roller 32, and thus, the outer peripheral surface of the pressure roller 32 is not deformed very much, in contrast to the flat nip NP shown in FIG. 2B. Accordingly, a speed of a sheet conveyed is easily calculable, and thus, accuracy of conveyance control is easy to improve. In addition, when leaving the nip NQ, a sheet is deflected in the direction of the pressure roller 32, and thus, the sheet is easy to separate from the fuser belt 31.

—Curve with the Same Shape as Profile of Fuser Belt—

Figure 9A:
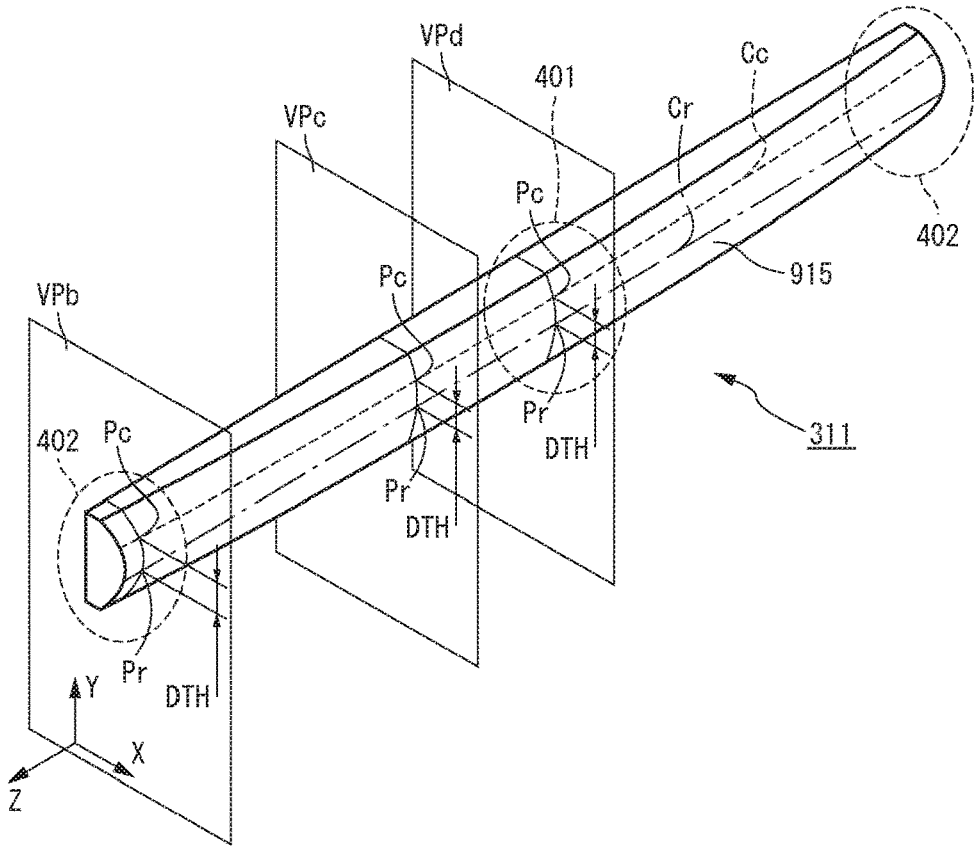
FIG. 9A is a perspective view of the pressure pad including a fourth modification of the pressure face.
Figures 9B, 9C, 9D:
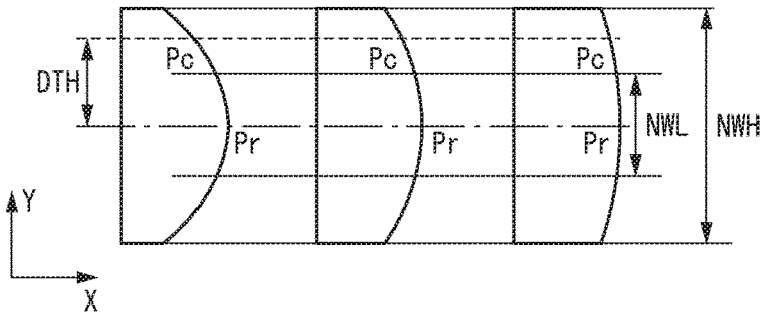
FIGS. 9B, 9C, and 9D are views of cross sections of the pressure pad that are intersections with virtual planes, respectively, normal to the longitudinal (Z-axis) direction.

FIG. 9A is a perspective view of the pressure pad 311 including a fourth modification 915 of the pressure face. FIGS. 9B, 9C, and 9D are views of cross sections of this pressure pad 311 that are intersections with virtual planes VPb, VPc, and VPd, respectively, normal to the longitudinal (Z-axis) direction. Like FIGS. 4A-E, FIGS. 9A-9D exaggerate the size of concave and convex portions of the pressure face 915 with respect to the length of each side thereof. As shown in FIGS. 9A-9D, the pressure face 915 has a profile with an arc-shaped convex in each cross section of the pressure pad 311. Especially in the center portion 401 of the pressure pad 311 in its longitudinal direction (the Z-axis direction in FIG. 9A), the convex has substantially the same shape as a portion of the fuser belt 31 in the nip, i.e. the arc of the convex in the width (Y-axis) direction of the nip has the same radius as the inner radius of the fuser belt 31. As shown in FIGS. 9B-9D, the arc of the convex has a smaller radius with increasing distance from the center portion 401 in the longitudinal (Z-axis) direction of the pressure pad 311. Thus, both edges of the nip in the width (Y-axis) direction are displaced in the direction of the force fP (the negative direction of the X axis).

The reference point Pr on each arc, i.e. the section of the arc to first come into contact with the outer peripheral surface of the pressure roller 32 with the fuser belt 31 in between when the nip is formed, is the nearest to the rotation axis of the pressure roller 32 (the largest X coordinate in FIGS. 9A-9D), i.e. at the peak of the convex. Also in the example shown in FIG. 9A, the reference line Cr is a straight line parallel to the longitudinal (Z-axis) direction of the pressure pad 311. In other words, any point on the reference line Cr is located at the same distance from the outer peripheral surface of the pressure roller 32. Accordingly, the entirety of the reference line Cr is always included in the nip, regardless of the strength of the force fP.

The arc with a smaller radius has the boundary point Pc located at the larger distance from the rotation axis of the pressure roller 32 in the (X-axis) direction of the force fP. Accordingly, the boundary line Cc bends away from the pressure roller 32 in the direction of the force fP (the negative direction of the X axis) with increasing distance from the center portion 401 of the pressure pad 311 in the longitudinal (Z-axis) direction. Thus, as shown in FIGS. 9B-9D, the boundary point Pc is, relative to the reference point Pr, more largely displaced in the opposite direction to the direction of the pressure roller 32 (the negative direction of the X axis, i.e. the boundary point Pc has a larger negative X coordinate when the reference point Pr is located at the origin of the X axis) with increasing distance from the center portion 401 in the longitudinal (Z-axis) direction.

Among points of each arc on the inner side of the boundary point Pc, differences in distance from the rotation axis of the fuser belt 31 are sufficiently small Since elastic deformation of the pressure pad 311 is negligible in comparison to that of the outer peripheral surface of the pressure roller 32, the nip has substantially the same shape as the pressure face 915, and thus, the nip under load of the lower strength level fL spreads only on the inner side of the boundary line Cc. Accordingly, like the nip in the central portion 401, the nip in both the end portions 402 has only a negligible ratio of an area nearer to the rotation axis of the fuser belt 31 than the reference line Cr. As a result, the nip pressure distribution is substantially the same as the distribution when the entirety of the pressure face has the same shape as that of the fuser belt 31. On the other hand, the nip under load of the higher strength level fH spreads across the maximum width of the pressure face 915, and thus, the nip in both the end portions 402 has edges in the width direction more largely curved away in the direction of the force fP (the negative direction of the X axis) than the nip in the central portion 401 has. As a result, in contrast to the nip in the central portion 401, the nip in both the end portions 402 has a non-negligible ratio of an area nearer to the rotation axis of the fuser belt 31 than the reference line Cr. Therefore, the nip pressure in both the end portions 402 decreases and the difference in nip pressure between the end portions and the center portion 401 is reduced, in comparison to the nip pressure distribution when the entirety of the pressure face has the same shape as that of the fuser belt 31.

Figure 9E:
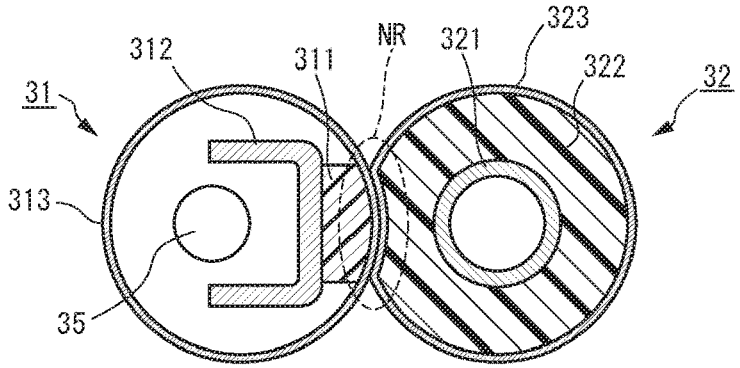
FIG. 9E is a cross-sectional view of the fuser belt and pressure roller showing the nip formed by the center portion of the pressure pad in its longitudinal direction along with the outer peripheral surface of the pressure roller.

FIG. 9E is a cross-sectional view of the fuser belt 31 and pressure roller 32 showing the nip NR formed by the center portion 401 of the pressure pad 311 in its longitudinal direction along with the outer peripheral surface of the pressure roller 32. In the center portion 401, the pressure face 915 has the same shape as that of the portion of the fuser belt 31 in the nip NR, and thus, the fuser belt 31 is not deformed very much, in contrast to the flat nip NP shown in FIG. 2B. Accordingly, when passing through the nip NR, the fuser belt 31 receives a reduced stress, and thus, durability of the fuser belt 31 is improved.

(G) Any of the pressure faces 315, 615, 715, 815, and 915 shown in FIGS. 4A, 6A, 7A, 8A, and 9A has a smooth profile in the virtual plane cutting the center portion 410 of the pressure pad 311. This profile may alternatively include a so-called indifferentiable section such as a step, a protrusion, or a groove. For example, the convex portion 601 or 701 of the pressure face 615 or 715 shown in FIG. 6 or FIG. 7 may extend from both the end portions 402 to the center portion 401 in the longitudinal direction of the pressure pad 311 (the Z-axis direction shown in FIG. 6 or FIG. 7). In other words, from the center portion 401, an area at the reference line Cr and its vicinity may protrude. Thus in the center portion 401, nip pressure at the reference line Cr is higher than that in the other areas, regardless of the strength of the force fP. Especially when an envelope passes through the nip between the pressure pad 311 and the pressure roller 32, sufficiently high nip pressure is maintained at an area of intersection between the center portion 410 and the reference line Cr. As a result, the front and back sheets of the envelope hardly slide over each other, and thus, defects such as paper wrinkle is prevented and print quality is improved.

(H) As shown in FIG. 5C, variation in nip pressure in the longitudinal (Z-axis) direction of the pressure pad 311 is as small when the force fP has the higher strength level fH as when the force fP has the higher strength level. In this case, nip pressure may be maintained at a significantly higher level in both the end portions Z=Z0, Z1 than in the center portion Z=Zc. Thus in the end portions Z=Z0, Z1, the outer peripheral surface of the pressure roller 32 is more largely compressed to exert a greater elastic force than in the center portion Z=Zc, hence having a higher tangential speed. As a result, friction forces that the outer peripheral surface of the pressure roller 32 apply to a sheet passing through the nip have components in the longitudinal direction from the center portion Z=Zc to either of the end portions Z=Z0, Z1. Since these components act on the sheet to spread the sheet, wrinkling of the sheet, esp. of the center of its rear portion, is prevented.

(I) In any of the pressure faces 315-915 shown in FIGS. 4A-9A, the reference line Cr is a straight line. The reference line may be alternatively shaped in a curve or angle with respect to the axial direction of the pressure roller 32.

Figure 10A:
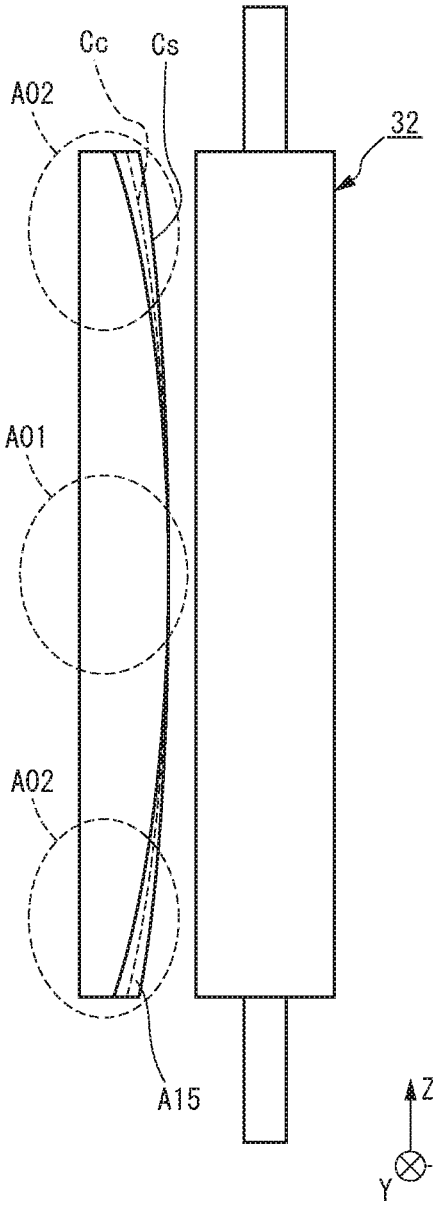
FIG. 10A is a side view of the pressure pad including a fifth modification of the pressure face when it is apart from the nip between it and the pressure roller.

FIG. 10A is a side view of the pressure pad 311 including a fifth modification A15 of the pressure face when it is apart from the nip between it and the pressure roller 32. Like FIGS. 4A-E, FIG. 10A exaggerates the size of concave and convex portions of the pressure face A15 with respect to the length of each side thereof. The pressure face A15 has such a three-dimensional shape as the pressure face 315 shown in FIG. 4A would be curved in the axial (Z-axis) direction of the pressure roller 32. Thus, the three-dimensional shape of the pressure face A15 is more similar to a "ryuko," the top face of a "koto" with strings stretched thereover, than the shape of the pressure face 315 shown in FIG. 4A. The pressure face A15 includes the reference line Cs at an area the nearest to the pressure roller 32. This reference line Cs, in contrast to the straight line Cr shown in FIG. 4A, is more largely curved away from the pressure roller 32 (in the negative direction of the X axis) with increasing distance from the center portion A01 in the axial (Z-axis) direction of the pressure roller 32. Although the boundary line Cc is similarly curved, its curvature is higher than that of the reference line Cs. Accordingly in both the end portions 402, the boundary line Cc is, relative to the reference line Cs, more largely displaced in the opposite direction to the direction of the pressure roller 32 (the negative direction of the X axis) than in the center portion 401.

The outer peripheral surface of the pressure roller 32 has a circular-cylindrical shape, and further, is parallel to its axial direction. Accordingly, in the reference line Cs curved with respect to the axial direction, unlike in the straight line Cr shown in FIG. 4A, the center portion A01 comes into contact with the outer peripheral surface of the pressure roller 32 with the fuser belt 31 in between earlier than both the end portions A02 when the nip is formed. When the force fP with the lower strength level fL is sufficiently strong, both the end portions A02, following the center portion A01, come into contact with the outer peripheral surface of the pressure roller 32 with the fuser belt 31 in between. Caused by the delayed contact, the outer peripheral surface of the pressure roller 32 has a portion in contact with the center portion A01 that is more largely compressed to exert a greater elastic force than another portion in contact with either of the end portions A02, and thus, the elastic force more largely contributes to the nip pressure. The curvature of the reference line Cs is so designed that the difference in contribution to the nip pressure between the center portion A01 and the end portions A02 compensates for the difference ΔPL in nip pressure caused by the deflection of the holding member 312. As a result, variation in nip pressure under load of the lower strength level fL is also reduced.

Figure 10B:
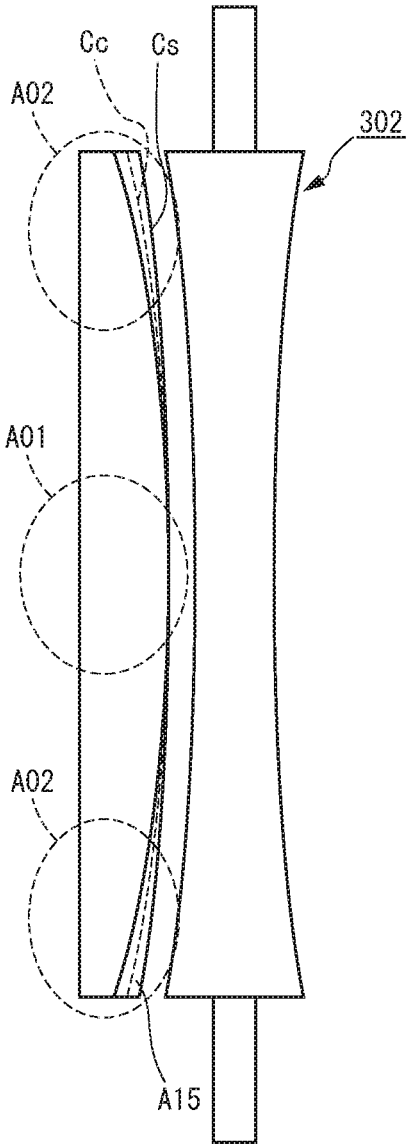
FIG. 10B is a side view of the pressure pad shown in FIG. 10A and a modification of the pressure roller when the pressure pad is apart from the nip between it and the pressure roller.

FIG. 10B is a side view of the pressure pad 311 shown in FIG. 10A and a modification 302 of the pressure roller when the pressure pad 311 is apart from the nip between it and the pressure roller 302. Like FIG. 10A, FIG. 10B exaggerates the size of concave and convex portions of the pressure face A15 with respect to the length of each side thereof. The pressure roller 302 has an outer peripheral surface with a reverse crown shape (also called as a flare shape) in place of a circular cylindrical shape. In other words, the outer peripheral surface of the pressure roller 32 has a profile in a cross section including the rotation axis of the pressure roller 32 that is curved to approach the pressure pad 311 (to be displaced in the negative direction of the X axis) with decreasing distance from either of the end portions A32 in the axial (Z-axis) direction of the pressure roller 32. In particular, the profile has the same shape as the reference line Cs of the pressure face A15 has. Thus, the entirety of the reference line Cs is always included in the nip regardless of the strength of the force fP. Since the outer peripheral surface of the pressure roller 32 has a reverse crown shape, each of the end portions A32 has a larger radius and a higher tangential speed than the center portion A31. As a result, friction forces that the outer peripheral surface of the pressure roller 32 applies to a sheet passing through the nip have components in the axial direction from the center portion to either of the end portions. Since these components act on the sheet to spread the sheet, wrinkling of the sheet, esp. of the center of its rear portion, is prevented.

Supplement

Based on the above-described embodiment, the invention may be further characterized as follows.

When the pressure pad forms the nip due to reception of the force from the pusher unit, the reference sections of profiles in cross sections of the pressure face may belong to the nip regardless of the strength of the force and the locations of the profiles. The threshold distance of each of the profiles may be a distance from the reference section thereof to an edge thereof in the width direction of the nip when the strength of the force equals a threshold value.

When the pressure pad is apart from the nip due to removal of the force applied by the pusher unit, the profiles of the pressure face may each have a shape of a smooth curve convex to the fuser rotator. This curve may have a higher mean curvature at a larger distance from the center portion of the pressure pad in the axial direction of the fuser rotator.

The reference section of each of the profiles may be located at the top of a portion convex to the fuser rotator. The distance from the reference section to the boundary section in the direction of the force applied by the pusher unit may be larger in one of the profiles located at a larger distance from the center portion of the pressure pad in the axial direction of the fuser rotator. The portion convex to the fuser rotator may be a smooth convex curve or a stepwise curve.

When the pressure pad is apart from the nip due to removal of the force applied by the pusher unit, some of the profiles belonging to the center portion of the pressure pad may be each a substantially straight line, or may each have substantially the same shape as a portion of the outer peripheral surface of the fuser rotator or a portion of the fuser belt that was put in the nip.

When the pressure pad is apart from the nip due to removal of the force applied by the pusher unit, a linear area on the pressure face in which the reference sections of the profiles from the center to edge portions of the pressure pad are located may be parallel to the rotation axis of the fuser rotator. Under this condition, the reference section may be farther from the rotation axis of the fuser rotator in one of the profiles located at a larger distance from the center portion of the pressure pad in the axial direction of the fuser rotator.

The ratio of a distance to the amount of a deflection of the holding member may be designed to be equal to or larger than a predetermined value. The distance is a distance from the boundary sections of a first group of the profiles to the boundary sections of a second group of the profiles in the direction of the force of the pusher unit when the pusher unit removes the force and the pressure pad is apart from the nip. The first group is a part of the profiles that belong to the center portion of the pressure pad, and the second group is another part of the profiles that belong to an edge portion of the pressure pad. The deflection of the holding member appears when the pusher unit applies the force and the pressure pad forms the nip. The fuser rotator may be a reverse crown roller. The fuser belt may be a free belt. The holding member may be in the form of a plate of U- or L-shaped cross section.

Although one or more embodiments of the present invention have been described and illustrated in detail, it is clearly understood that the same is by way of illustration and example only and not limitation; the scope of the present invention should be interpreted by terms of the appended claims.

What is claimed is:

1. A fuser for applying heat and force to a surface of a sheet with a toner image transferred thereon to fix the toner image on the surface of the sheet, the fuser comprising:

an endless fuser belt;

a fuser rotator extending along a rotation axis;

a pressure pad forming a nip, along with the fuser rotator, with the fuser belt between the pressure pad and an outer peripheral surface of the fuser rotator;

a holding member elongated in an axial direction of the fuser rotator and holding the pressure pad;

a heater unit applying heat to one of the fuser belt and the outer peripheral surface of the fuser rotator; and a pusher unit applying a force of variable strength between the outer peripheral surface of the fuser rotator and the pressure pad, the pressure pad comprising:

a pressure face to be in contact with the fuser belt at the nip, having profiles at edges of cross sections of the pressure pad when the pressure pad is apart from the nip due to removal of the force applied by the pusher unit; the cross sections being intersections with virtual planes normal to a rotation axis of the fuser rotator; the profiles each including:

a reference section to be the first to come into contact with the outer peripheral surface of the fuser rotator with the fuser belt in between when the pusher unit applies the force and the pressure pad forms the nip; and a boundary section being located at a threshold distance from the reference section in the width direction of the nip, and being, relative to the reference section, more largely displaced in the opposite direction to the direction of the fuser rotator in one of the profiles located at a larger distance from a center portion of the pressure pad in the axial direction of the fuser rotator.

2. The fuser according to claim 1, wherein the reference section of each of the profiles is a part of the nip regardless of the strength of the force applied by the pusher unit and the location of the profiles when the pressure pad forms the nip due to reception of the force, and the threshold distance of each of the profiles is a distance from the reference section thereof to an edge thereof in the width direction of the nip when the strength of the force equals a threshold value.

3. The fuser according to claim 1, wherein the profiles of the pressure face each have a shape of a smooth curve convex to the fuser rotator when the pressure pad is apart from the nip due to removal of the force applied by the pusher unit, and the curve has a higher mean curvature at a larger distance from the center portion of the pressure pad in the axial direction of the fuser rotator.

4. The fuser according to claim 1, wherein the reference section of each of the profiles is located at the top of a portion convex to the fuser rotator, and the distance from the reference section to the boundary section in the direction of the force applied by the pusher unit is larger in one of the profiles located at a larger distance from the center portion of the pressure pad in the axial direction of the fuser rotator.

5. The fuser according to claim 4, wherein the portion convex to the fuser rotator is a smooth convex curve.

6. The fuser according to claim 4, wherein the portion convex to the fuser rotator is a stepwise curve.

7. The fuser according to claim 1, wherein some of the profiles that belong to the center portion of the pressure pad are each a substantially straight line when the pressure pad is apart from the nip due to removal of the force applied by the pusher unit.

8. The fuser according to claim 1, wherein some of the profiles that belong to the center portion of the pressure pad each have substantially the same shape as a portion of the outer peripheral surface of the fuser rotator when the pressure pad is apart from the nip due to removal of the force applied by the pusher unit.

9. The fuser according to claim 1, wherein some of the profiles that belong to the center portion of the pressure pad each have substantially the same shape as a portion of the fuser belt that was put in the nip when the pressure pad is apart from the nip due to removal of the force applied by the pusher unit.

10. The fuser according to claim 1, wherein a linear area on the pressure face in which the reference sections of the profiles from the center to edge portions of the pressure pad are located is parallel to the rotation axis of the fuser rotator when the pressure pad is apart from the nip due to removal of the force applied by the pusher unit.

11. The fuser according to claim 1, wherein one of the profiles located at a larger distance from the center portion of the pressure pad in the axial direction of the fuser rotator has the reference section located farther from the rotation axis of the fuser rotator when the pressure pad is apart from the nip due to removal of the force applied by the pusher unit.

12. The fuser according to claim 1, wherein:

the ratio of a distance to the amount of a deflection of the holding member is designed to be equal to or larger than a predetermined value;

the distance is a distance from the boundary sections of a first group of the profiles to the boundary sections of a second group of the profiles in the direction of the force of the pusher unit when the pusher unit removes the force and the pressure pad is apart from the nip;

the first group is a part of the profiles that belongs to the center portion of the pressure pad, and the second group is another part of the profiles that belongs to an edge portion of the pressure pad; and the deflection of the holding member appears when the pusher unit applies the force and the pressure pad forms the nip.

13. The fuser according to claim 1, wherein the fuser rotator is a reverse crown roller.

14. The fuser according to claim 1, wherein the fuser belt is a free belt.

15. The fuser according to claim 1, wherein the holding member is in the form of a plate of U- or L-shaped cross section.

16. An image forming apparatus comprising:

an imaging unit forming a toner image on an image carrier;

a transfer unit transferring the toner image onto a sheet; and a fuser unit applying heat and force to the surface of the sheet with the toner image transferred to fix the toner image on the surface of the sheet, the fuser unit comprising:

an endless fuser belt;

a fuser rotator extending along a rotation axis;

a pressure pad forming a nip, along with the fuser rotator, with the fuser belt between the pressure pad and an outer peripheral surface of the fuser rotator;

a holding member elongated in an axial direction of the fuser rotator and holding the pressure pad;

a heater unit applying heat to one of the fuser belt and the outer peripheral surface of the fuser rotator; and a pusher unit applying a force of variable strength between the outer peripheral surface of the fuser rotator and the pressure pad, the pressure pad comprising a pressure face to be in contact with the fuser belt at the nip, having profiles at edges of cross sections of the pressure pad apart from the nip with the pusher unit removing the force; the cross sections being intersections with virtual planes normal to a rotation axis of the fuser rotator;

the profiles each including:

a reference section to be the first to come into contact with the outer peripheral surface of the fuser rotator with the fuser belt in between when the pusher unit applies the force and the pressure pad forms the nip; and a boundary section being located at a threshold distance from the reference section in the width direction of the nip, and being, relative to the reference section, more largely displaced in the opposite direction to the direction of the fuser rotator in one of the profiles located at a larger distance from a center portion of the pressure pad in the axial direction of the fuser rotator.

* * * * *